US008540236B2

(12) United States Patent
Ohtani et al.

(10) Patent No.: US 8,540,236 B2
(45) Date of Patent: Sep. 24, 2013

(54) PAPER FEEDING DEVICE AND IMAGE FORMING APPARATUS

(75) Inventors: Akizou Ohtani, Osaka (JP); Fujio Tabata, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/536,057

(22) Filed: Jun. 28, 2012

(65) Prior Publication Data

US 2012/0267844 A1 Oct. 25, 2012

Related U.S. Application Data

(62) Division of application No. 12/819,293, filed on Jun. 21, 2010, now Pat. No. 8,231,124.

(30) Foreign Application Priority Data

Jun. 23, 2009 (JP) ..... 2009-148239
Jun. 29, 2009 (JP) ..... 2009-153365
Jun. 3, 2010 (JP) ..... 2010-127775

(51) Int. Cl.
*B65H 1/18* (2006.01)

(52) U.S. Cl.
USPC ..... 271/152; 271/157; 271/110; 271/154

(58) Field of Classification Search
USPC ..... 271/152, 153, 154, 155, 157, 110
See application file for complete search history.

(56) References Cited

U.S. PATENT DOCUMENTS 4,960,272 A * 10/1990 Wierszewski et al. ..... 73/1.81
5,700,003 A * 12/1997 Sung ..... 271/110
5,908,188 A 6/1999 Katamoto et al.
6,252,654 B1 6/2001 Kaya (Continued)

FOREIGN PATENT DOCUMENTS

JP 6336352 12/1994
JP 7172623 7/1995

(Continued)

OTHER PUBLICATIONS

Office Action Summary in parent case (U.S. Appl. No. 12/819,293) dated Feb. 23, 2012—pp. 1-5.

(Continued)

*Primary Examiner* — Kaitlin Joerger
*Assistant Examiner* — Ernesto Suarez
(74) *Attorney, Agent, or Firm* — Gerald E. Hespos; Michael J. Porco; Matthew T. Hespos

(57) ABSTRACT

A remaining amount detector measures beforehand a distance H where there is one sheet. A motor displaces a lifting plate to a paper-feeding position upon storing paper in the feeding unit. The remaining amount detector measures a distance y1 to the lower face of a paper stack. Thereafter, upon transport of paper from the stack, a control unit causes the remaining amount detector to measure a distance y2 for every predetermined number n of fed sheets. A remaining sheet calculation unit calculates a displacement y1−y2=Δy to the bottom of the paper stack S, and calculates the thickness of one sheet on the basis of the displacement Δy and the number n of fed sheets (t=Δy/n). The remaining sheet calculation unit divides the thickness (H−y2) of the paper stack by the thickness t of one paper sheet, and calculates the number of remaining sheets m as (m=((H−y2)/t)+1).

4 Claims, 18 Drawing Sheets

(56) References Cited

U.S. PATENT DOCUMENTS

| | | | | |
|---|---|---|---|---|
| 6,585,344 | B2 | 7/2003 | Kolodziej | |
| 6,874,780 | B2 * | 4/2005 | Rebeaud | 271/154 |
| 7,144,008 | B2 | 12/2006 | Suzuki | |
| 7,255,504 | B2 | 8/2007 | Kim | |
| 7,523,930 | B2 | 4/2009 | Kang | |
| 7,549,626 | B2 | 6/2009 | Cook et al. | |
| 7,664,926 | B2 * | 2/2010 | Kato et al. | 711/171 |
| 7,673,789 | B2 | 3/2010 | DeBusk et al. | |
| 7,913,995 | B2 * | 3/2011 | Clark et al. | 271/126 |
| 7,978,381 | B2 | 7/2011 | Sheng et al. | |
| 8,061,706 | B2 | 11/2011 | Freeston | |
| 2009/0166950 | A1 * | 7/2009 | Sciurba et al. | 271/9.03 |
| 2011/0101600 | A1 * | 5/2011 | Chihara et al. | 271/152 |

FOREIGN PATENT DOCUMENTS

| | | |
|---|---|---|
| JP | 10-274869 | 10/1998 |
| JP | 20007189 | 1/2000 |
| JP | 2000-281243 | 10/2000 |
| JP | 2001-114452 | 4/2001 |
| JP | 2001328760 | 11/2001 |
| JP | 2003233276 | 8/2003 |
| JP | 200931579 | 2/2009 |

OTHER PUBLICATIONS

Notice of Allowability in parent case (U.S. Appl. No. 12/819,293) dated Apr. 4, 2012—pp. 1-5 and Notices of References Cited.

* cited by examiner

PAPER FEEDING DEVICE AND IMAGE FORMING APPARATUS

CROSS-REFERENCE TO RELATED APPLICATIONS

This application is a divisional of U.S. patent application Ser. No. 12/819,293 filed on Jun. 21, 2010.

BACKGROUND OF THE INVENTION

1. Field of the Invention

The present invention relates to a paper feeding device that stores a paper stack and that feeds paper sheets, and to an image forming apparatus that comprises the paper feeding device.

2. Description of the Related Art

Paper feeding devices used in image forming apparatuses such as multifunction machines, fax machines, printers or the like, are configured in such a manner that paper is fed out, sheet by sheet, out of a paper stack that is stored in the paper feeding device. The fed-out paper sheet is fed to an image forming unit in the image forming apparatus, so that an image formed in the image forming unit is transferred to the paper sheet.

Such paper feeding devices may have installed therein a sensor for detecting the number of remaining sheets in the paper feeding device, in order to notify an out-of-paper occurrence to users, when paper runs out.

For instance, (1) in known image forming apparatuses paper is replenished into a paper feeding device by way of a manual paper feeding unit, and an accurate number of remaining sheets is grasped by counting the number of replenished paper sheets at that time.

(2) In other known paper feeding devices, the distance down to the topmost paper sheet in a paper stack is measured by a distance sensor provided above the stored paper, the thickness per paper sheet is calculated on the basis of the number of printed sheets and the displacement of the paper position, and the remaining paper amount is estimated.

(3) In another ordinary configuration of paper feeding devices, a paper stack is placed on a lifting plate, and a pickup roller feeds out, sheet by sheet, the topmost sheet on the paper stack. A motor raises one end of the lifting plate, to tilt thereby the entire lifting plate in such a manner that the topmost face of the paper stack is at all times at a position abutting the pickup roller. The inclination angle of the lifting plate varies depending on the remaining sheets in the paper stack S. The above configuration is used in proposed methods for determining the number of remaining sheets on the basis of the inclination angle of the lifting plate.

SUMMARY OF THE INVENTION

The present invention further improves the above conventional inventions.

Specifically, the present invention is a paper feeding device having: a recording medium storing section which stores a recording medium to be fed; a transport section which feeds out and transports, sheet by sheet, said recording medium from said recording medium storing section; a lifting section on which the recording medium stored in said recording medium storing section is placed, and one end side of which is raised so as to cause the recording medium to abut said transport section, and which has an opening to expose the lowermost face of the placed recording medium; a measurement unit which is disposed below said lifting section, and which measures, from below the lifting section and through said opening, a first distance up to the lowermost face of said recording medium placed on said lifting section, and a second distance up to the lowermost face of said recording medium placed on said lifting section, after said recording medium is transported by said transport section; and a calculation unit which calculates the number of sheets of said recording medium that is placed on said lifting section, on the basis of said measured first and second distances.

DETAILED DESCRIPTION OF THE PREFERRED EMBODIMENTS

First Embodiment

Figure 1:
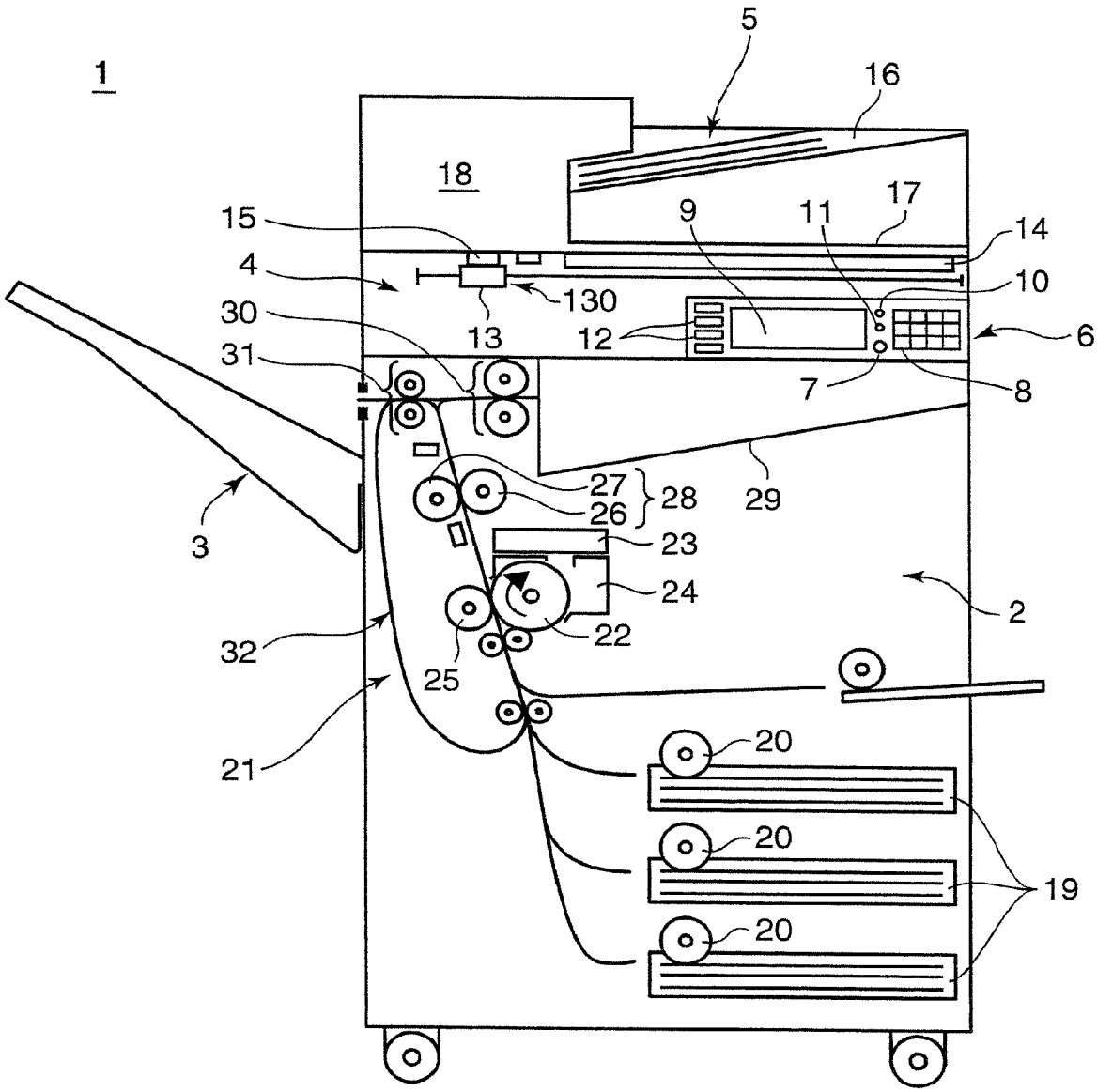
FIG. 1 is a side-view diagram illustrating schematically the internal configuration of an image forming apparatus.

An explanation follows next on a first embodiment of the image forming apparatus comprising the paper feeding device of the present invention, with reference to accompanying drawings. FIG. 1 is a side-view diagram illustrating schematically the internal configuration of a image forming apparatus 1 comprising paper feeding units 19 that are the paper feeding device according to the present invention. The image forming apparatus 1 is a multifunction machine that combines the functions of, for instance, copying machine, printer, scanner, fax machine and so forth. The image forming apparatus 1 comprises a main body 2, a stack tray 3 provided on a left side of a main body 2, a document reading unit 4 provided in the upper portion of the main body 2, and a document feeding unit 5 provided on top of the document reading unit 4.

An input operating unit 6 is provided at the front of the image forming apparatus 1. The input operating unit 6 comprises a start key 7 for allowing the user to input instructions such as a printing execution instruction or the like; numerical keys 8 for inputting, for instance, the number of print copies; a display unit 9 comprising, for instance, a liquid crystal display which displays, for instance, operation guide information of various copying operations, and which has a touch panel function for input of various settings; a reset key 10 for resetting, for instance, settings set through the display unit 9; a stop key 11 for stopping a printing (image forming) operation in progress; and a function switching key 12 for switching functions between a copying function, a printer function, a scanner function, and a facsimile function.

The document reading unit 4 comprises a scanner 13 that has an image sensor (not shown) in which there is fixedly provided a CCD (Charge Coupled Device) sensor or a CMOS (Complementary Metal Oxide Semiconductor, and a movable optical unit 130 that comprises, for instance, an exposure lamp (not shown) and a lens (not shown). The document reading unit 4 comprises also a document holder 14 made of a transparent member such as glass, and a document reading slit 15. The movable optical unit 130 of the scanner unit 13 is configured so as to be movable by a driving unit, not shown. To read a document placed on the document holder 14, the movable optical unit 130 is moved along the document surface while positioned so as to face the document holder 14, to acquire image data while scanning the document. To read a document fed by the document feeding unit 5, the movable optical unit 130 is moved to a position facing the document reading slit 15, and stops at that position. In that state, the movable optical unit 130 acquires image data by scanning an image of the document, via the document reading slit 15, in synchrony with a document transport operation by the document feeding unit 5.

The document feeding unit 5 comprises a document placement unit 16 for document placement; a document discharge unit 17 for discharging documents the images whereof have already been read; and a document transport mechanism 18 comprising, for instance, a paper feeding roller, a transport roller and the like (not shown) for feeding out, one by one, the documents placed on the document placement unit 16, towards a position facing the document reading slit 15, and for discharging the documents to the document discharge unit 17.

The document feeding unit 5 is provided pivotably with respect to the main body 2, in such a manner that the front face side of the document feeding unit 5 can swing up. The front face side of the document feeding unit 5 swings up to open thereby the top face of the document holder 14. As a result, document images can be read when the user places a document to be read, for instance a double-page spread book, on the top face of the document holder 14.

The main body 2 comprises a plurality of paper feeding units 19; pickup rollers 20 (transport section) that feed out paper, sheet by sheet, from the paper feeding units 19, and transport the paper towards an image forming unit 21; and the image forming unit 21 that forms an image on the paper that is transported by any one of the paper feeding units 19.

The image forming unit 21 comprises, for instance, an optical unit 23 that emits, for instance, a laser beam on the basis of the image data acquired by the scanner unit 13, to expose thereby a photosensitive drum 22, and to form as a result an electrostatic latent image on the surface of the photosensitive drum 22; a developing unit 24 that forms a toner image by developing, with toner, the electrostatic latent image that is formed on the surface of the photosensitive drum 22; and a transfer section 25 that transfers onto paper the toner image formed on the photosensitive drum 22. The main body 2 further comprises, for instance, a fixing device 28 including a heating roller 26 and a pressure roller 27 that fix the toner image on the paper, through heating of the paper having the toner image transferred thereon; and a pair of transport rollers 30 and 31, provided in the paper transport path of the image forming unit 21, that transport the paper towards the stack tray 3 or an output tray 29.

When images are to be formed on both faces of a paper sheet, an image is formed, by the image forming unit 21, on one of the faces of the paper sheet, after which the paper sheet is nipped by the transport roller pair 30 on the side of the output tray 29. In this state, a rotation direction of the transport roller pair 30 is reversed, whereupon the paper sheet is switched back. The paper sheet is transported again along the paper transport path 32 towards the upstream region of the image forming unit 21, and an image is formed, by the image forming unit 21, on the other face of the paper sheet, after which the paper sheet is discharged to the stack tray 3 or the output tray 29.

Figure 2:
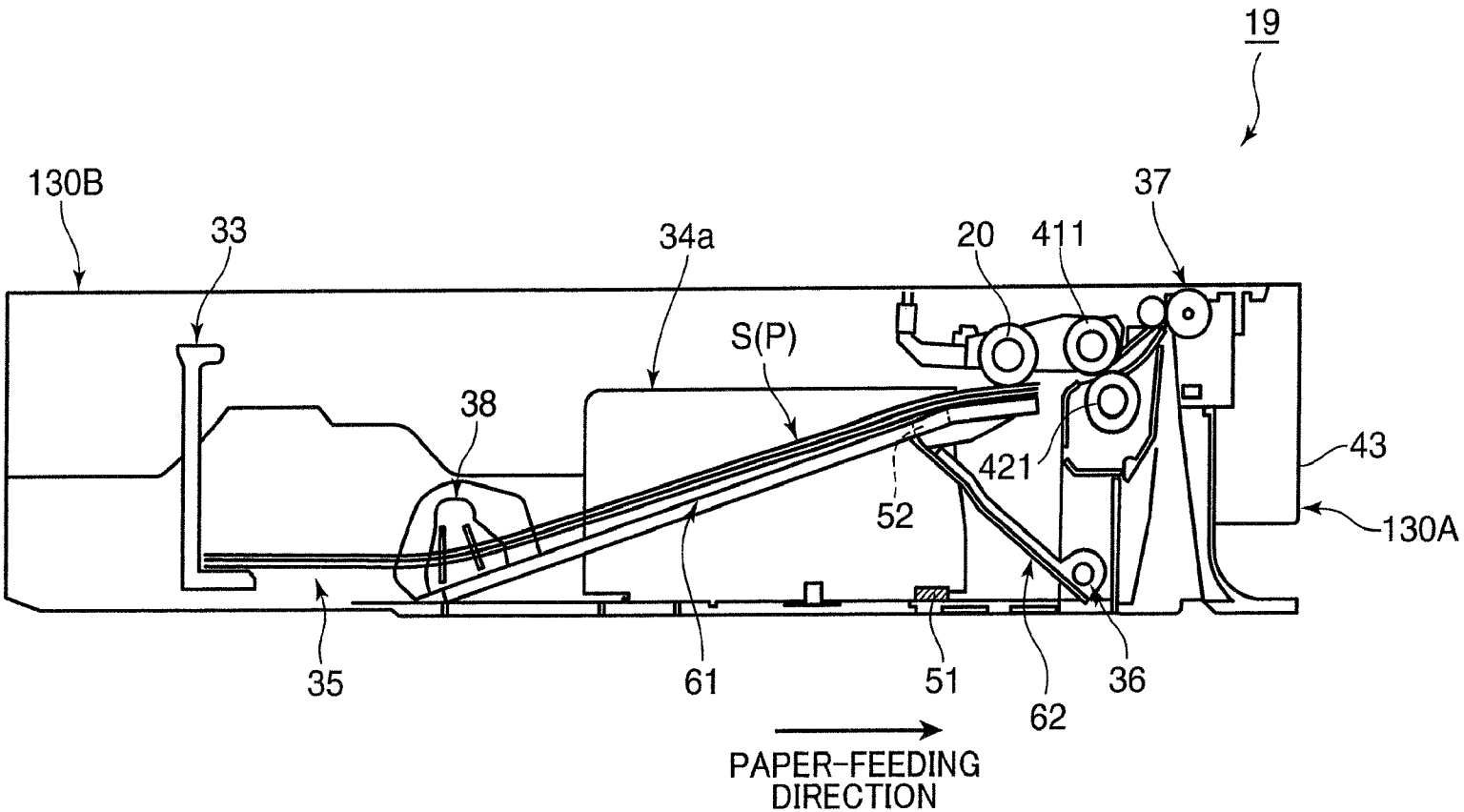
FIG. 2 is a cross-sectional diagram of a paper feeding unit.
Figure 3:
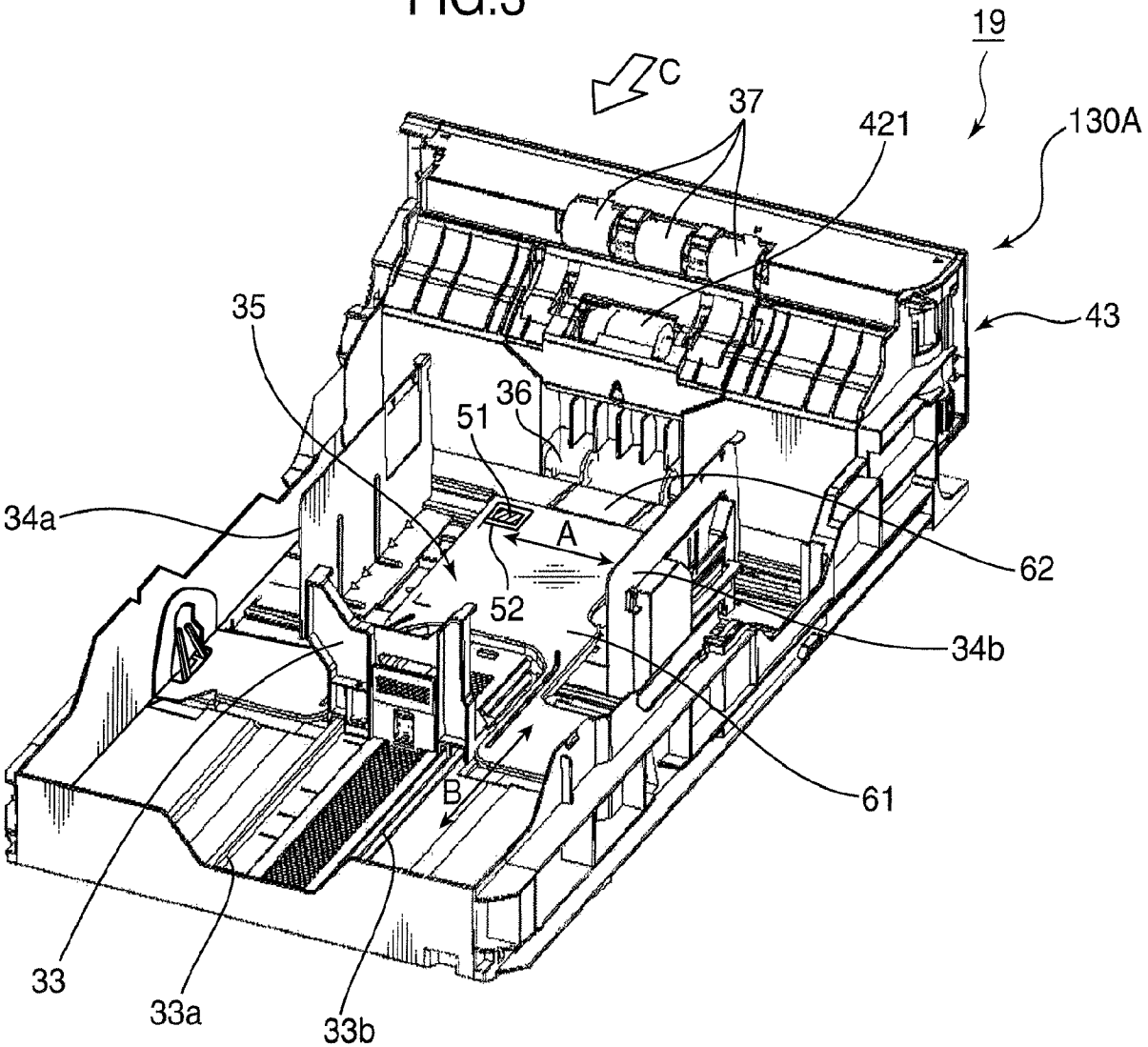
FIG. 3 is a perspective-view diagram of the paper feeding unit.

The paper feeding units 19 are explained in detail next. FIG. 2 is a cross-sectional diagram illustrating the configuration of the paper feeding units 19. FIG. 3 is a perspective-view diagram of the paper feeding unit 19.

As illustrated in FIGS. 2 and 3, a paper feeding cassette 130A of the paper feeding unit 19 comprises a lifting plate 61 (lifting section), provided on the inner bottom face of a paper storing section 35, and on which there is stacked a paper stack S that comprises a plurality of paper sheets P. The upstream end of the lifting plate 61 in the paper-feeding direction (left end in FIG. 2) is pivotably supported by support sections 38. Inside the paper storing section 35, thus, the lifting plate 61 can pivot in the vertical plane by way of the support sections 38, the downstream end of the lifting plate 61 being herein the free end. The support sections 38 are provided at both wall side portions of the paper storing section 35, that oppose each other across the width direction of the paper sheets P (direction perpendicular to the paper-feeding direction).

The paper feeding cassette 130A (recording medium storing section) comprises a width-matching cursor pair 34*a* and 34*b* that aligns, in the width direction, the paper sheets P stored in the paper storing section 35; and a rear end cursor 33 that aligns the rear end of the paper sheets P. The width-matching cursor pair 34*a* and 34*b* is provided so that each cursor can move back and forth in the sheet width direction (direction of arrow A in FIG. 3), along a guide rail not shown. The rear end cursor 33 is provided so as to be capable of moving back and forth parallel to the sheet transport direction (i.e. in the direction of arrow B in FIG. 3) along guide rails 33*a* and 33*b*. The paper stack S can be stored at a predetermined position in the paper feeding unit 19 through displacement of the width-matching cursor pair 34*a* and 34*b* and the rear end cursor 33 in accordance with the size of the stacked paper sheets. The paper feeding cassette 130A further comprises a cassette cover 43, the front face side whereof (side viewed from the direction of arrow C in FIG. 3) is exposed outwards and makes up part of the outer face of the image forming apparatus 1.

At the lower portion of the lifting plate 61, downstream in the paper-feeding direction, there are provided as a lifting mechanism for lifting the lifting plate 61, a driving shaft 36, a push-up member 62, and a drive coupling member (not shown). On the side of the paper feeding unit main body 130B there are provided a receiving member (not shown) for the drive coupling member, and a motor 95 (FIG. 4), capable of normal and reverse rotation, that is coupled to the receiving member. The drive coupling member of the paper storing section 35 on the side of the paper feeding cassette 130A is locked with and coupled to the receiving member on the side of the paper feeding unit main body 130B when the paper feeding cassette 130A is stored in the paper feeding unit main body 130B. Therefore, The power of the motor 95 can be transmitted thereby to the driving shaft 36. The driving shaft 36, the push-up member 62, the drive coupling member, the receiving member and the motor 95 make up the lifting mechanism that displaces the lifting plate 61 between a paper-feeding position and a retreat position.

The paper-feeding position is a position at which the top face of the paper stack S, placed on the raised lifting plate 61, abuts the pickup rollers 20, enabling thereby feeding of the paper sheets. The retreat position is the lowermost position to which the lifting plate 61 is lowered. The motor 95 comprised in the lifting mechanism that lifts the lifting plate 61 may be, for instance, a stepping motor, a DC motor or the like.

As illustrated in FIG. 2, the paper feeding unit 19 comprise each a paper feeding roller 411 provided downstream of the pickup roller 20 in the transport direction, a handling roller 421 disposed below the paper feeding roller 411, and a transport roller 37 provided downstream of the pickup roller 20 and the paper feeding roller 411, in the paper transport direction.

The paper feeding roller 411 feeds paper sheet P, picked up by the pickup roller 20, to the transport roller 37. The paper feeding roller 411 rotates in a direction that allows the paper sheets P to be fed downstream. By contrast, the handling roller 421 rotates in a direction inverse to that of the paper feeding roller 411, i.e. in a direction so as to cause the paper sheet P to be fed back upstream. The handling roller 421 prevents paper sheets from being fed towards the transport roller 37, except for a topmost paper sheet P, even in case that several stacked paper sheets P are picked up by the pickup roller 20. As a result, only the topmost paper sheet P is fed by the paper feeding roller 411 towards the transport roller 37.

A remaining amount detecting sensor 51 (measurement unit), for measuring the distance up to the lowermost face of the paper stack S, is disposed at the bottom of the paper feeding cassette 130A, below the lifting plate 61. An opening 52 is formed in the lifting plate 61 at a position corresponding to the measurement site of the remaining amount detecting sensor 51. Through the opening 52, the remaining amount detecting sensor 51 measures directly the distance up to the rear face of the lowermost paper sheet P of the paper stack S that is placed on the lifting plate 61, and outputs the measurement result to a below-described control unit. The control unit calculates the number of sheets in the paper stack S on the basis of the measurement result. The calculation method is explained in detail further on.

The remaining amount detecting sensor 51 comprises at least a light-emitting element that irradiates a light beam, at a predetermined angle, towards the opening 52; a light-receiving element that receives reflected light of the light beam emitted by the light-emitting element; and an arithmetic unit that calculates, by triangulation, the distance up to the reflection position of the light emitted by the light-emitting element, on the basis of the arrival point at which the reflected light strikes the light-receiving element. The remaining amount detecting sensor 51 is a so-called distance sensor that utilizes a triangulation method.

The remaining amount detecting sensor 51 is disposed at either position further out than the sides of the push-up member 62 in the direction of the arrow A, as illustrated in FIG. 3, in such a manner that the light emitted by the remaining amount detecting sensor 51 is not cut off by the push-up member 62. Further, the remaining amount detecting sensor 51 and the opening 52 are disposed in such a manner that the pickup roller 20 (and the shaft (not shown) for rotating the pickup roller 20) are not positioned within the measurement area of the remaining amount detecting sensor 51, so that the light emitted by the remaining amount detecting sensor 51 through the opening 52 is not reflected by the pickup roller 20 when no paper is left on the lifting plate 61. With the above conditions in mind, the opening 52 is disposed in the lifting plate 61 at a position (downstream end of the paper sheets P in the transport direction) as close as possible to the pickup roller 20, with a view to increasing the detection precision of the paper sheet number. The remaining amount detecting sensor 51 is disposed immediately below the opening 52.

Figure 4:
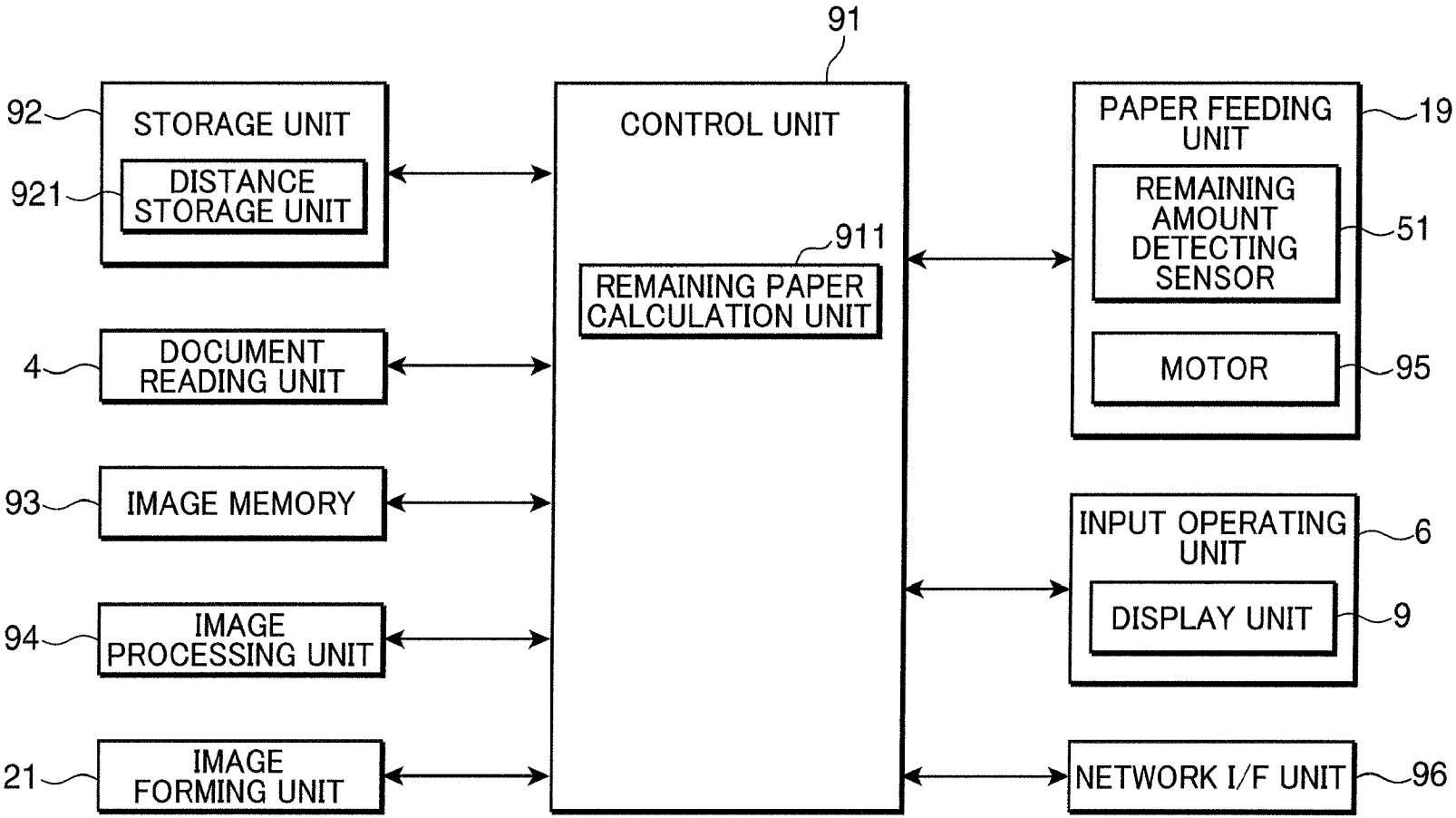
FIG. 4 is a block diagram illustrating the electric configuration of the image forming apparatus.

FIG. 4 is a block diagram illustrating the electric configuration of the image forming apparatus 1. The image forming apparatus 1 comprises a control unit 91, a storage unit 92, the document reading unit 4, an image memory 93, an image processing unit 94, the image forming unit 21, the paper feeding unit 19, the input operating unit 6 and a network I/F unit 96. The same constituent elements explained in FIGS. 1 to 3 are denoted with identical reference numerals, and a recurrent explanation thereof will be omitted.

The storage unit 92 stores, for instance, programs and data for executing the various functions of the image forming apparatus 1, and functions also as a distance storage unit 921. The distance storage unit 921 stores the distance to the lowermost face of remaining sheets placed on the lifting plate 61 at a time when the lifting plate 61 is raised highest, namely when the number of remaining sheets on the lifting plate 61 is one sheet. The image memory 93 stores temporarily image data acquired by the document reading unit 4, or image data sent from an external device via the network I/F unit 96. The image processing unit 94 performs image processing, such as image correction, enlargement/reduction and the like, on the image data stored in the image memory 93.

The motor 95 of each paper feeding unit 19 is a driving source that displaces the push-up member 62 (i.e. that raises and lowers the lifting plate 61). The network I/F unit 96, which comprises a communication module such as an LAN board or the like, exchanges various data with an external device by way of a network (not shown) that is connected to the network I/F unit 96.

The control unit 91 comprises, for instance, a CPU (Central Processing Unit). The control unit 91 controls collectively the image forming apparatus 1 by, for instance, executing a process of reading a program stored in the storage unit 92, by outputting instructions signals to the various functional units, and by transmitting data. The control unit 91 has a remaining paper calculation unit 911 (calculation unit).

Figure 5A:
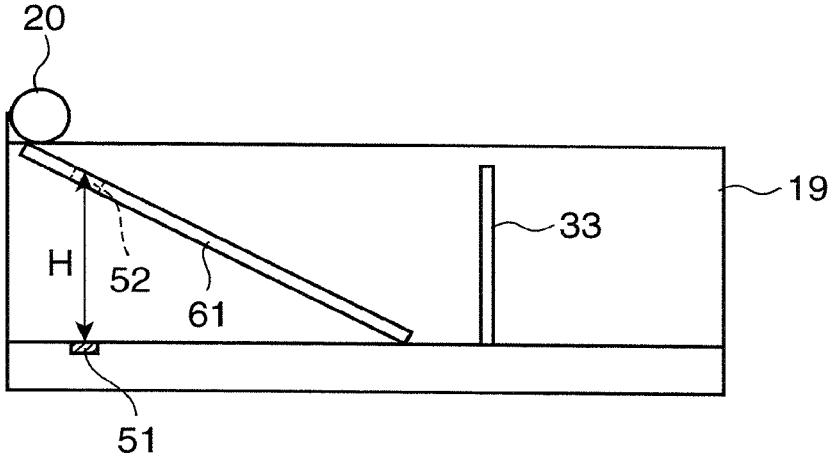
FIGS. 5A to 5C are a set of schematic cross-sectional diagrams of the paper feeding unit in a first embodiment.
Figure 5B:
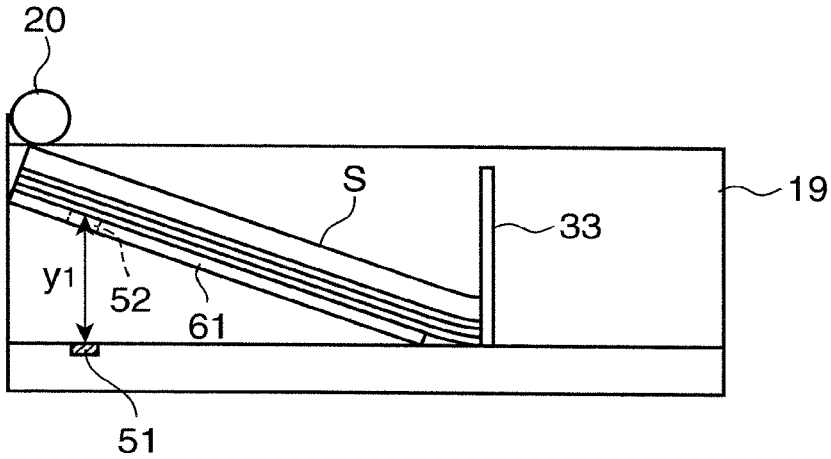
Figure 5C:
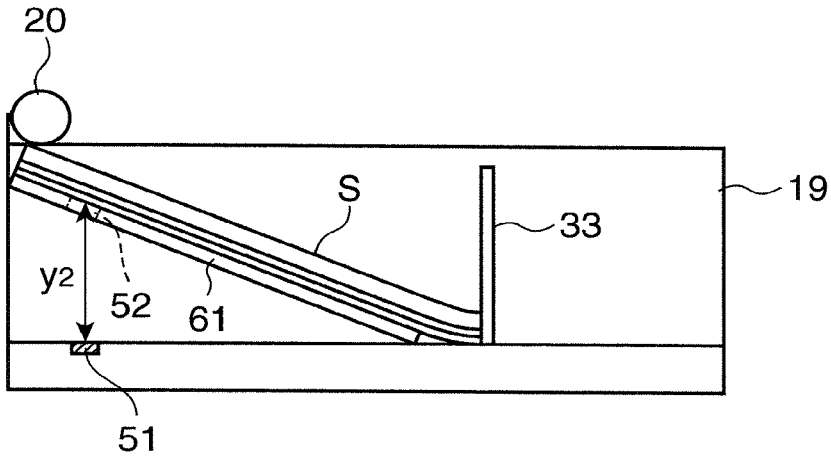

The remaining paper calculation unit 911 calculates the number of remaining sheets that are placed on the lifting plate 61, on the basis of the distance up to the lowermost face of the paper stack S, as outputted by the remaining amount detecting sensor 51. An example of the method for calculating the number of remaining sheets will be explained with reference to FIGS. 5A to 5C. FIGS. 5A to 5C are schematic cross-sectional diagrams of a paper feeding unit 19. Firstly, the control unit 91 causes the remaining amount detecting sensor 51 to measure a distance H at a time when there is one paper sheet left on the lifting plate 61 (FIG. 5A), for instance before shipping of the image forming apparatus 1 out of the factory.

The detected distance at this time is stored in the distance storage unit 921. The paper used for this measurement is usually normal paper.

To feed paper from the paper feeding unit 19, the motor 95 causes the lifting plate 61 to shift to a position at which the top face of the paper stack S abuts the pickup roller 20 (FIG. 5B). The control unit 91 causes the remaining amount detecting sensor 51 to measure a distance y1 to the bottom face of the paper stack S.

Thereafter, to start feeding paper towards the image forming unit 21 by way of the pickup roller 20, the motor 95 raises, each time one sheet of paper is fed from the paper feeding unit 19, the lifting plate 61 in such a manner that the top face of the paper stack S is at the paper-feeding position at all times (FIG. 5C).

The control unit 91 causes the remaining amount detecting sensor 51 to measure the distance once every predetermined fed sheets n. Herein, y2 denotes a hypothetical detected distance after feeding of n paper sheets. The remaining paper calculation unit 911 calculates the displacement $y1-y2=\Delta y$ of the distance to the bottom face of the paper stack S, and calculates the thickness ($t=\Delta y/n$) of one paper sheet on the basis of the displacement $\Delta y$ and the number n of fed sheets. The remaining paper calculation unit 911 calculates the number of remaining sheets $m(m=((H-y2)/t)+1)$ by adding 1 to the quotient of the thickness $(H-y2)$ of the paper stack S, in the measurement direction of the remaining amount detecting sensor 51, divided by the thickness t.

Figure 18A:
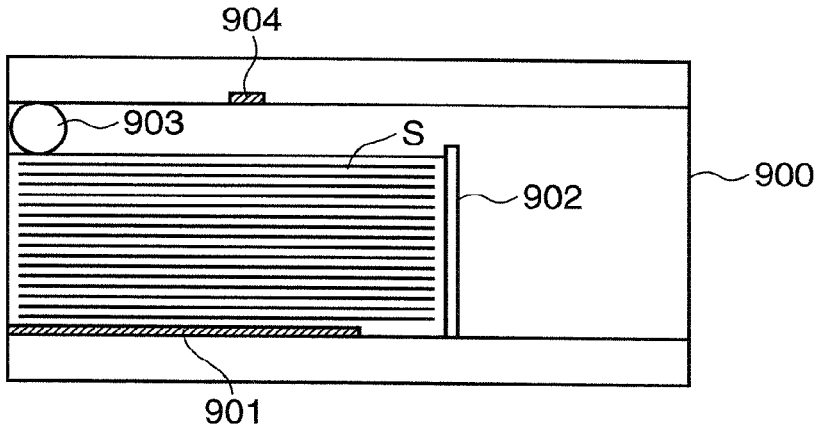
PRIOR ART FIG.18A
FIGS. 18A to 18C are a set of schematic cross-sectional diagrams of a conventional paper feeding device.
Figure 18B:
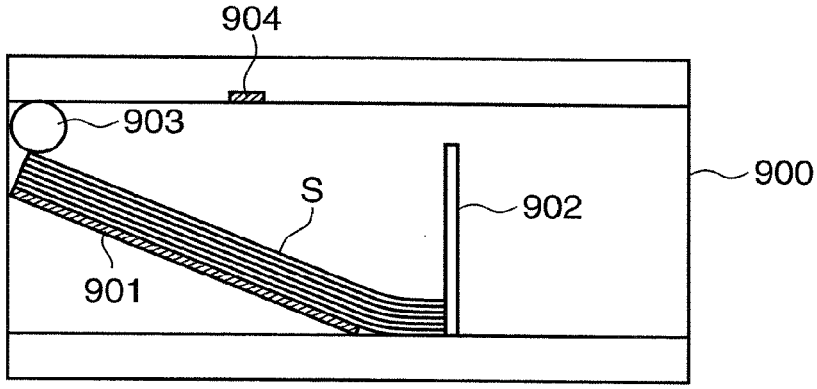
PRIOR ART FIG.18B
Figure 18C:
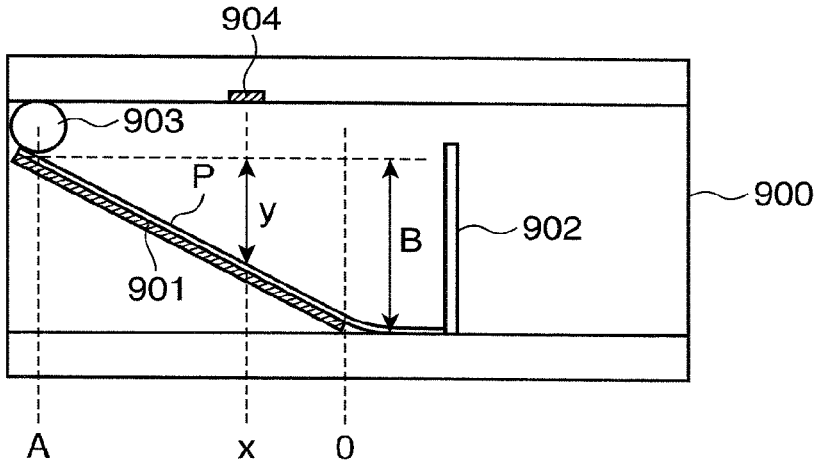
PRIOR ART FIG.18C

Indicating in FIG. 18A to 18C, a distance sensor 904 (corresponding to the remaining amount detecting sensor 51 in the present embodiment) was conventionally disposed above the paper stack. Therefore, it was necessary to dispose the distance sensor 904 upstream, in the transport direction, of the smallest paper size. The maximum displacement y of the measured distance of the distance sensor 904 was accordingly small, and the displacement per paper sheet P was likewise small, which precluded grasping accurately the number of remaining sheets in the paper stack S.

In the present embodiment, however, the remaining amount detecting sensor 51 is disposed below the lifting plate 61, at a position that matches the position of the opening 52, which in turn is disposed, in the lifting plate 61, at a position as close as possible to the pickup roller 20 (downstream end in the transport direction of the paper sheets P). The remaining amount detecting sensor 51 is thus disposed immediately below the opening 52, as a result of which the number of remaining sheets can be calculated on the basis of a greater displacement $\Delta y$, regardless of paper size. This allows improving the precision with which the number of remaining sheets is detected.

If the paper sheets P used are of thick paper having a different thickness from that of normal paper, the distance H for one remaining sheet of thick paper may differ slightly from the distance H for one remaining sheet of normal paper. That is, the number of remaining sheets m calculated using the distance H measured for normal paper may be erroneous upon determination of the number of remaining sheets for thick paper. When thick paper is to be stored in the paper feeding unit 19, therefore, one paper sheet of thick paper 1 is set in the paper feeding unit 19, before printing, and the lifting plate 61 is raised until the thick paper is at the paper-feeding position. Thereupon, the control unit 91 causes the remaining amount detecting sensor 51 to measure the distance H at that time, and stores the distance H in, for instance, a working memory (not shown) provided in the control unit 91. Later, when the user sets a plurality of thick paper sheets and launches printing, the number of thick remaining sheets is calculated on the basis of the distance H stored in the work memory. The number of remaining sheets m can thus be accurately worked out even for paper having a different thickness from that of normal paper.

Figure 6:
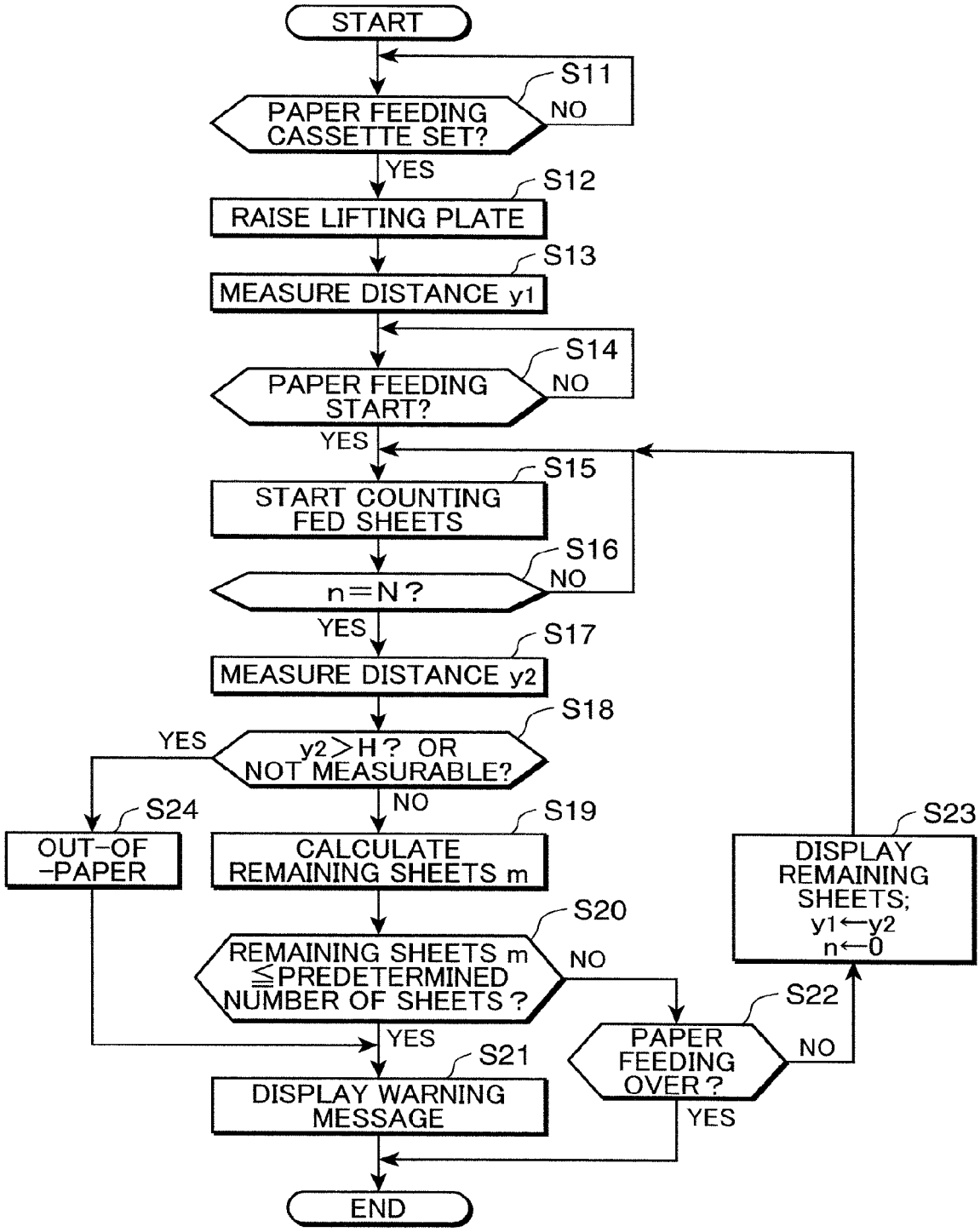
FIG. 6 is a flowchart illustrating the flow of a remaining sheet number detection process in the first embodiment.

FIG. 6 is a flowchart illustrating the flow of a remaining sheet number detection process in the present embodiment. When papers is stored in the paper feeding cassette 130A, and the latter is fitted to the main body 2 (step S11; YES), the control unit 91 controls the motor 95 so as to raise the lifting plate 61 until the paper stack S reaches the paper-feeding position (step S12). Once the paper stack S reaches the paper-feeding position, the control unit 91 causes the remaining amount detecting sensor 51 to measure the distance y1 up to the bottom face of the paper stack S (step S13).

Next, upon paper feeding start (step S14; YES), the remaining paper calculation unit 911 counts the number n of fed sheets (step S15). During paper feeding, the control unit 91 controls the motor 95 so as to raise the lifting plate 61 by an increment proportional to the reduction in paper sheets, in such a manner that the paper stack S is at the paper-feeding position at all times.

When the number n of fed sheets reaches N (N is an integer equal to or greater than 1, for instance N=10) (step S16; YES), the control unit 91 causes the remaining amount detecting sensor 51 to measure a distance y2 to the bottom face of the paper stack S (step S17), and determines whether the measured distance y2 is greater than the distance H stored in the distance storage unit 921 or cannot be measured (step S18). When the distance y2 is greater than the distance H or cannot be measured, it means that no paper sheets P are on the lifting plate 61. That is, when paper sheets P are on the lifting plate 61, the light emitted by the remaining amount detecting sensor 51 passes through the opening 52, is reflected on the rear face of the paper sheets P, and strikes again the remaining amount detecting sensor 51. When no paper sheets P are on the lifting plate 61, however, the light emitted by the remaining amount detecting sensor 51 passes through the opening 52, is reflected, for instance, near the upper portion of the lifting plate 61, and the light strikes again the remaining amount detecting sensor 51. However, the emitted light may also be reflected in another direction, so that the reflected light may fail to strike the remaining amount detecting sensor 51.

Therefore, when the measured distance y2 is greater than the distance H stored in the distance storage unit 921, or cannot be measured (step S18; YES), the control unit 91 concludes that paper has run out (step S24), and causes a warning message to be displayed on the display unit 9, to inform the user that paper has run out (step S21), whereupon the process is terminated.

If the distance y2 is no greater than the distance H (step S18; NO), the remaining paper calculation unit 911 calculates the displacement $\Delta y$ of the distance on the basis of the measured distances y1 and y2, and calculates the thickness t of the paper sheets P by dividing the displacement $\Delta y$ by the number n of fed sheets (N). The remaining paper calculation unit 911 calculates then the number of remaining sheets m by adding 1 to the quotient obtained by dividing, by the thickness t, the difference between the distance H stored beforehand, at a time when there is one paper sheet left, and the distance y2 (step S19).

When the number of remaining sheets m is no greater than a predetermined number of paper sheets (for instance, no more than 5 paper sheets) (step S20; YES), the control unit 91 causes a warning message to be displayed on the display unit 9, to inform the user that paper is about to run out (step S21), whereupon the process is terminated.

On the other hand, when the number of remaining sheets is greater than a predetermined paper sheet number (step S20; NO), and paper feeding is not yet over (printing in progress) (step S22; NO), the control unit 91 causes the number of remaining sheets to be displayed on the display unit 9. In large printing runs, thus, the user can estimate whether the paper is going to run out halfway during printing, on the basis of number of remaining sheets as displayed on the display unit 9. The control unit 91 resets the number n of fed sheets by substituting the distance y2 for the distance y1 (step S23), and the process proceeds to step S15. Once paper feeding is over (step S22; YES), the control unit 91 terminates the process.

As explained above, the remaining amount detecting sensor 51 is disposed below the lifting plate 61, immediately below the position of the opening 52 that is disposed, in the lifting plate 61, at a position as close as possible to the pickup roller 20 (downstream end in the transport direction of the paper sheets P). As a result, the number of remaining sheets can be calculated on the basis of a greater displacement Δy of the measured distance by the remaining amount detecting sensor 51, regardless of paper size. This allows improving the precision with which the number of remaining sheets is detected.

The present embodiment can be appropriately modified without departing from the purpose of the present invention. For instance, the present embodiment has been explained on the basis of the paper feeding unit 19 illustrated in FIG. 2, but the present embodiment applies also to the high-capacity paper feeding device 70 illustrated in FIG. 7.

Figure 7:
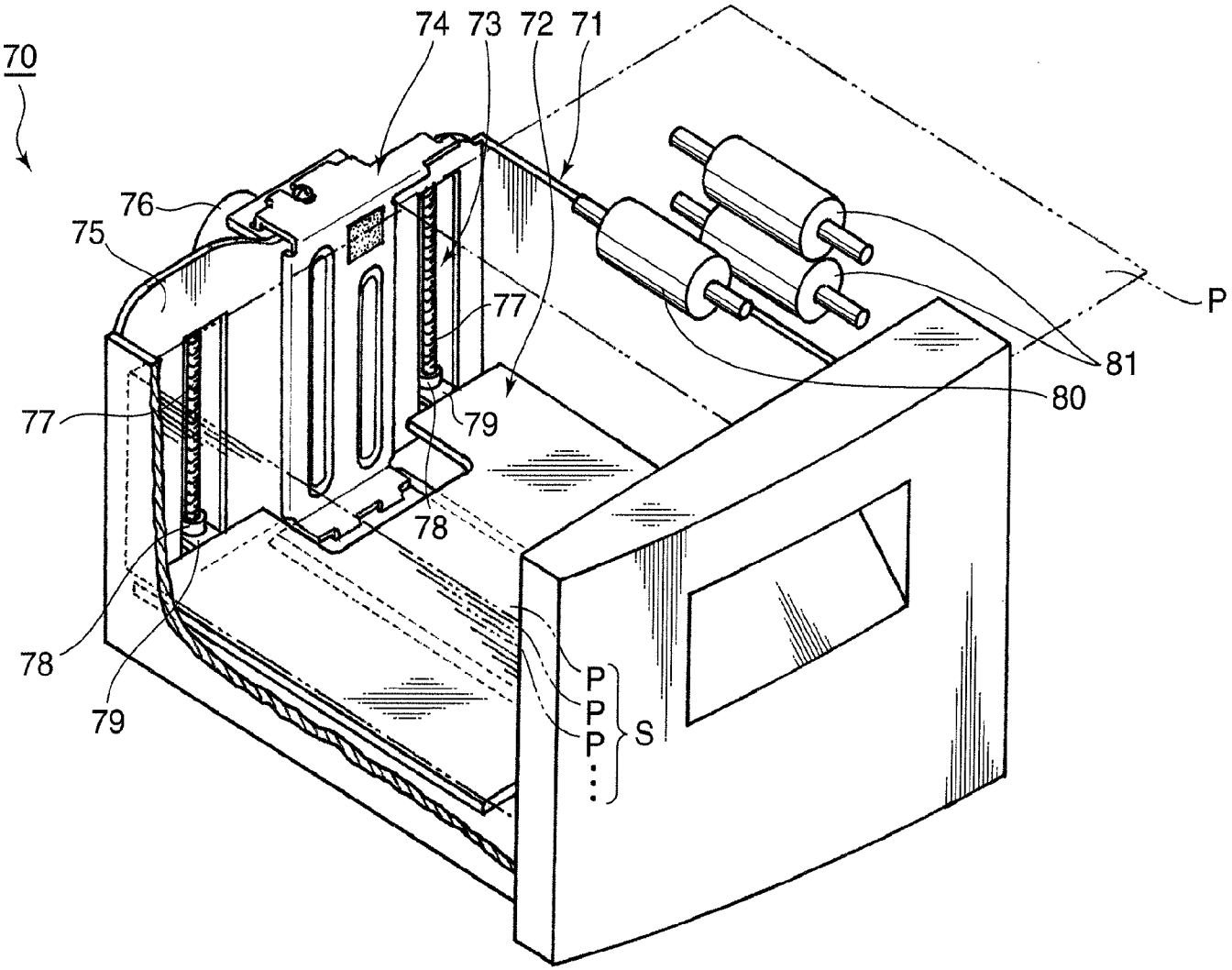
FIG. 7 is a perspective-view diagram of a high-capacity paper feeding device.

FIG. 7 is a perspective-view diagram illustrating an example of a high-capacity paper feeding device 70. The high-capacity paper feeding device 70 comprises a bottomed box 71 with the top face whereof is open; a lifting plate 72 fitted in the box 71 and on which the paper stack S is placed; a lifting mechanism 73 that raises and lowers the lifting plate 72; and an vertically elongated width-matching guide plate (far-side abutting stop plate) 74 that is operated in accordance with the size of the paper placed on the lifting plate 72.

The lifting mechanism 73, which raises and lowers the lifting plate 72, comprises a motor 76 fitted on the rear face side of a rear face plate 75; and a pair of spiral rods 77 that rotate about respective axes thereof on account of the driving power of the motor 76 that is transmitted via a driving power transmission not shown. Nut members 78 are screwed to the spiral rods 77. In that state, normal and reverse rotation of the spiral rods 77 about respective axes thereof causes the lifting plate 72 to be raised and lowered, by way of each nut member 78 and a guided projection 79. A pickup roller 80 feeds out paper sheets P positioned at the top face of the paper stack S that is stored in the high-capacity paper feeding device 70. A paper feeding roller pair 81 transports the paper sheets P toward a paper transport path.

Figure 8A:
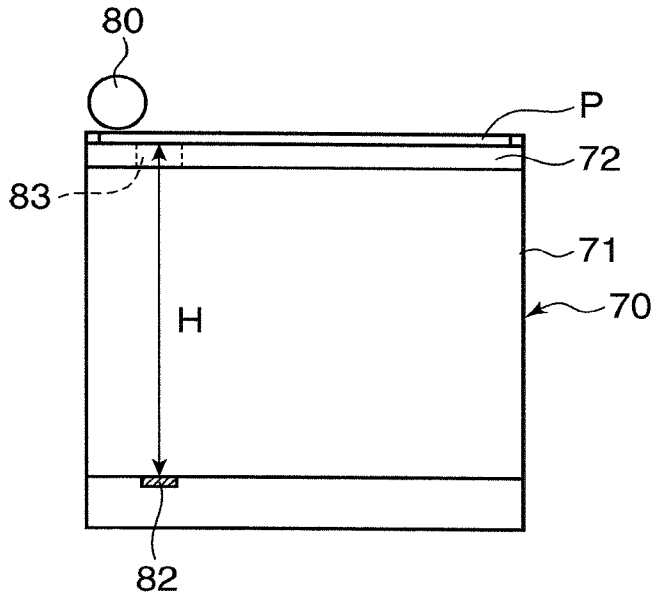
FIGS. 8A and 8B are a set of schematic cross-sectional diagrams of the high-capacity paper feeding device in the first embodiment.
Figure 8B:
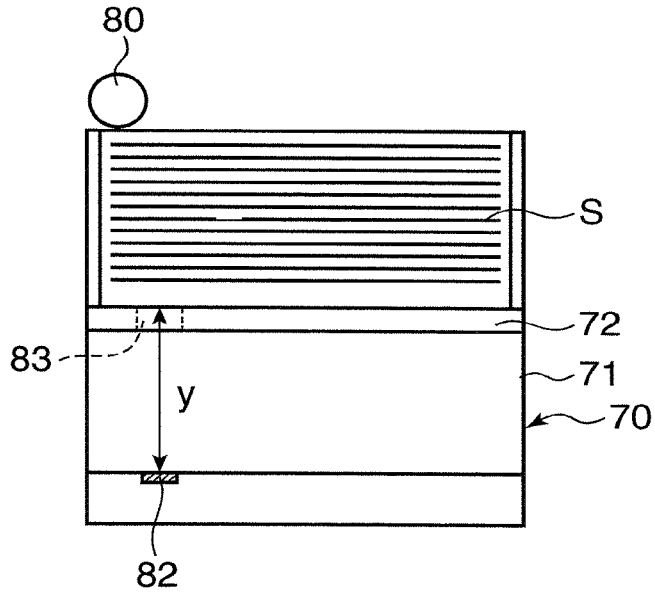

FIGS. 8A and 8B are a set of schematic cross-sectional diagrams illustrating an example of the high-capacity paper feeding device 70. FIG. 8A illustrates an instance where one paper sheet is left, and FIG. 8B illustrates an instance where a stored paper stack S is stored. A remaining amount detecting sensor 82 is disposed at the bottom of the box 71. The remaining amount detecting sensor 82 measures the distance up to the lower face of the paper sheets P or paper stack S, by way of an opening 83 that is provided in a lifting plate 72. The method for calculating the number of remaining sheets is identical to the method described above, and hence will not be explained again.

When the remaining amount detecting sensor is disposed above the paper stack S in such a high-capacity paper feeding device 70, as is the case in conventional devices, the distance between the remaining amount detecting sensor and the paper stack does not vary even when the paper sheets P are being outputted from the high-capacity paper feeding device 70, and hence the number of remaining sheets cannot be detected. Therefore, the remaining amount detecting sensor 82 is disposed at the bottom of the box 71, to allow thereby the number of remaining sheets to be calculated accurately. Further, the remaining amount detecting sensor is disposed at the same position as that of the paper feeding unit 19 in which only one lifting plate is raised and lowered. As a result, the high-capacity paper feeding device 70 and the paper feeding unit 19 can be configured so as to share some constituent members, which contributes to reducing costs.

Second Embodiment

The explanation in the first embodiment above dealt with an instance in which paper is determined to have run out when the measurement result by the remaining amount detecting sensor 51 is greater than a distance H or the distance cannot be measured. In the present embodiment an instance will be explained in which a trough is provided on the side of the apparatus main body, and in which the light emitted by the remaining amount detecting sensor 51 passes through the opening 52 and irradiates the trough when paper has run out. The mechanical and electric configurations of the image forming apparatus of the present embodiment are identical to those of the image forming apparatus 1 explained in the first embodiment. Identical constituent elements are denoted thus with the same reference numerals, and a recurrent explanation thereof will be omitted, except for features that are dissimilar.

Figure 9A:
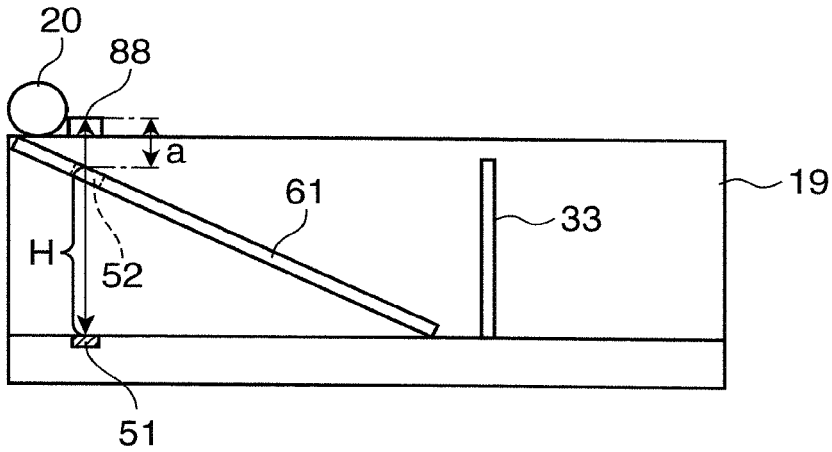
FIGS. 9A and 9B are a set of schematic cross-sectional diagrams of a high-capacity paper feeding device and a paper feeding unit in a second embodiment.
Figure 9B:
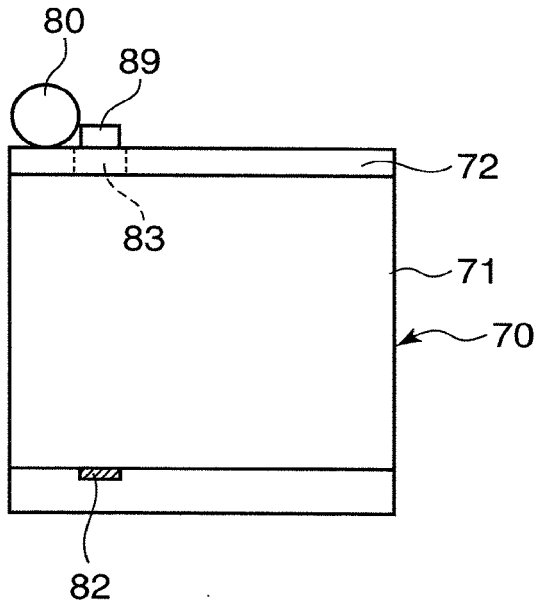

FIG. 9A is a schematic cross-sectional diagram of a paper feeding unit 19. FIG. 9B is a schematic cross-sectional diagram illustrating an example of the high-capacity paper feeding device 70. As illustrated in FIG. 9A, a trough 88 is provided in the main body 2 at a position corresponding to the irradiation position of the light emitted by the remaining amount detecting sensor 51 and that passes through the opening 52 when paper runs out. The distance detected by the remaining amount detecting sensor 51 when the paper sheets P have run out is now y=H+a, on account of the presence of the trough 88. That is, the distance detected by the remaining amount detecting sensor 51 is y=H at a time when there is one paper sheet left on the lifting plate 61, but becomes y=H+a when paper runs out, i.e., the detected distance y increases abruptly by the distance a. Therefore, the control unit 91 can detect out-of-paper conditions reliably, and with greater detection precision.

In the case of the high-capacity paper feeding device 70 illustrated in FIG. 9B as well, the control unit 91 can detect out-of-paper conditions reliably thanks to a trough 89 that is provided in the main body 2 at a position corresponding to the irradiation position of the light emitted by the remaining amount detecting sensor 82 and that passes through the opening 83 when paper runs out.

Figure 10:
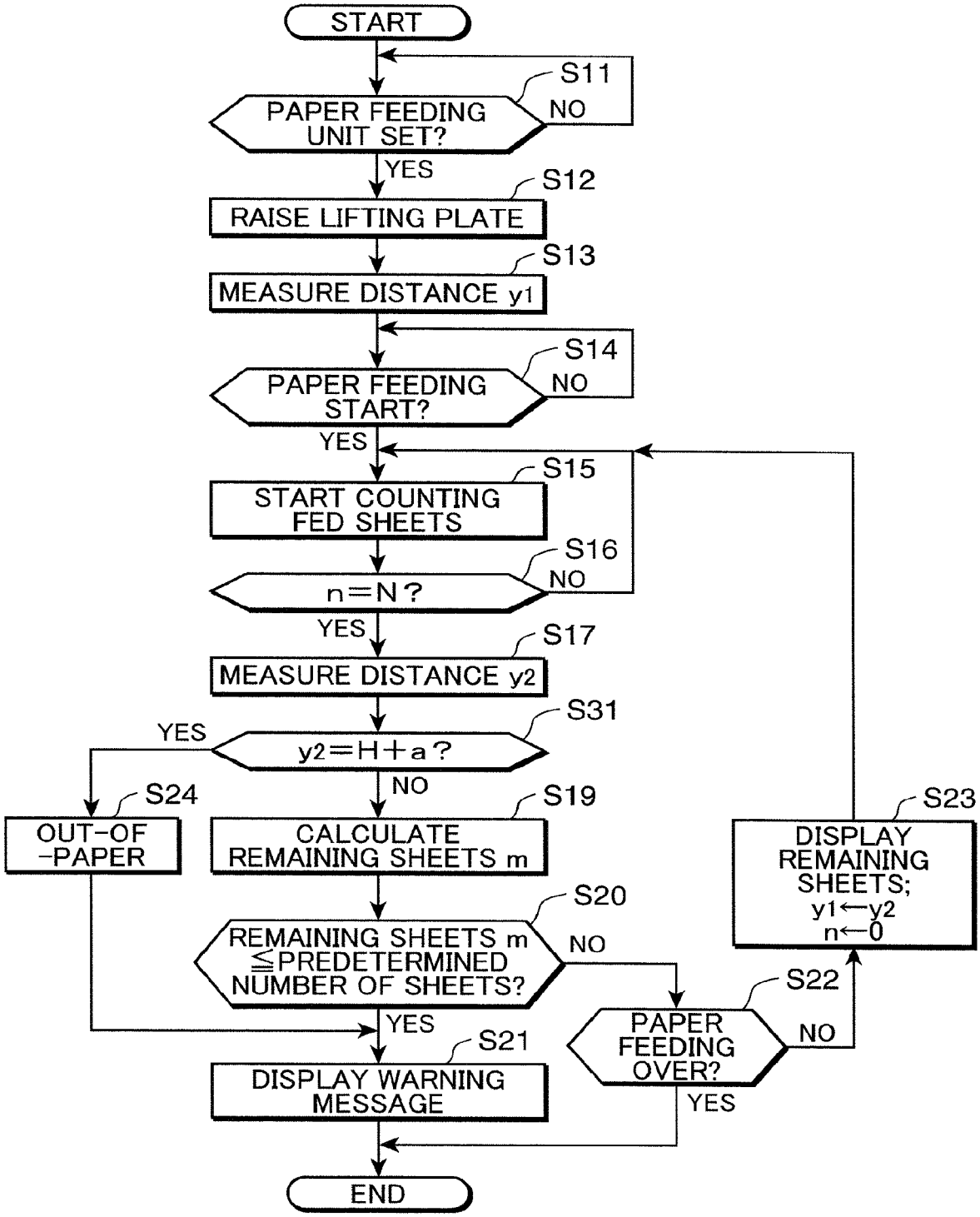
FIG. 10 is a flowchart illustrating the flow of a remaining sheet number detection process in the second embodiment.

FIG. 10 is a flowchart illustrating the flow of a remaining sheet number detection process in the present embodiment. The flowchart of the remaining sheet number detection process differs from that of the first embodiment, explained with reference to FIG. 6, in that step S18 is modified in the present embodiment. Accordingly, only step S18 will be explained.

When the number n of fed sheets reaches N (step S16; YES), the control unit 91 causes the remaining amount detecting sensor 51 to measure a distance y2 to the bottom face of the paper stack S (step S17), and determines whether the measured distance y2 is equal to the sum of the distance H and the distance a (step S31). The distance a, which denotes the distance from the top face of the lifting plate 61 to the trough 88, is measured beforehand, and is stored in the distance storage unit 921.

When the measured distance y2 is equal to the sum of the distance H and the distance a (step S31; YES), the control unit 91 concludes that paper has run out (step S24), and causes a warning message to be displayed on the display unit 9, to inform the user that paper has run out (step S21) whereupon the process is terminated. On the other hand, when the measured distance y2 is not equal to the sum of the distance H and the distance a (step S31; NO), the remaining paper calculation unit 911 calculates the number of remaining sheets m (step S19).

Third Embodiment

Figure 11:
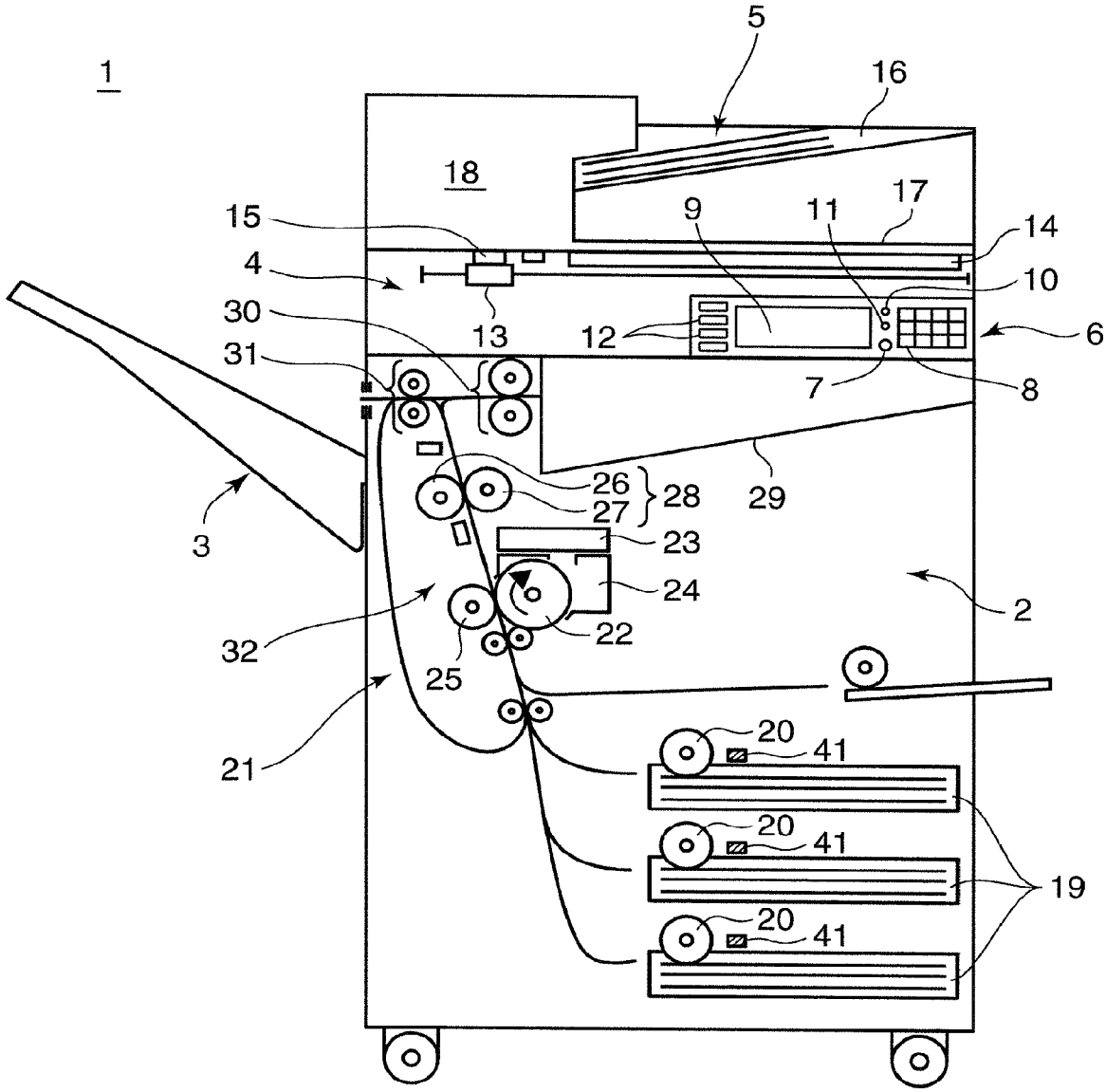
FIG. 11 is a side-view diagram illustrating schematically the internal configuration of an image forming apparatus.

An explanation follows next on a third embodiment of the image forming apparatus provided with the paper feeding device of the present invention, with reference to accompanying drawings. FIG. 11 is a side-view diagram illustrating schematically the internal configuration of an image forming apparatus 1 comprising paper feeding units 19 that are the paper feeding device according to the third embodiment. Features identical to those in the first or second embodiment will not be explained again.

In the third embodiment, a distance sensor (measurement unit) 41, for measuring the distance to the topmost face of the paper stack that is stored in each paper feeding unit 19, is disposed above the paper feeding unit 19.

The image forming apparatus 1 has an ordinary mode and a power saving mode in which power consumption is lower than in the ordinary mode. In the ordinary mode, power is supplied to all the circuits that make up the image forming apparatus 1, such as circuits in the power system, for instance the motor, motor driver and so forth, and circuits in the logic system, such as control devices, sensors and so forth. In the power saving mode, power is supplied to the circuits of the logic system, but is shut off for the circuits of the power system, as a result of which power consumption is reduced vis-à-vis that in the ordinary mode.

Figure 12A:
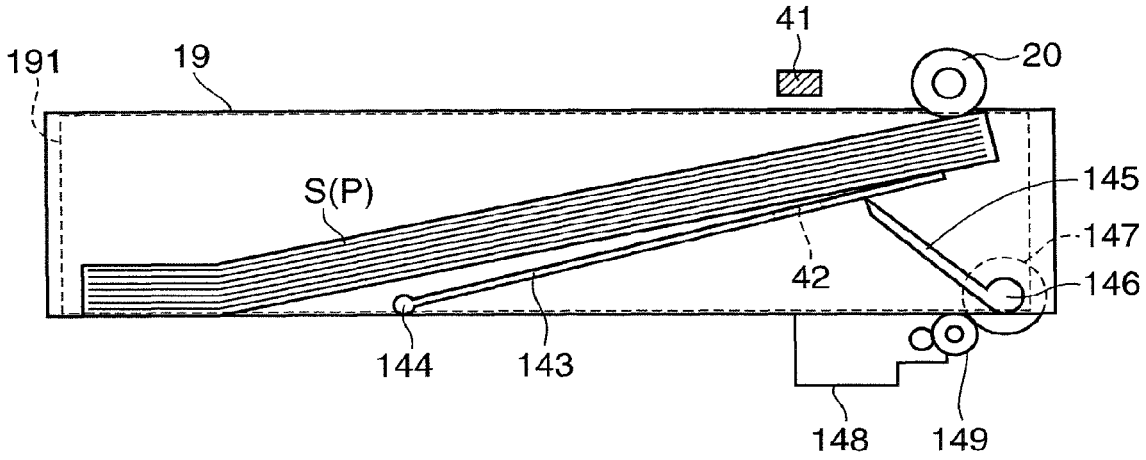
FIGS. 12A and 12B are a set of schematic cross-sectional diagrams of the paper feeding unit in the third embodiment.
Figure 12B:
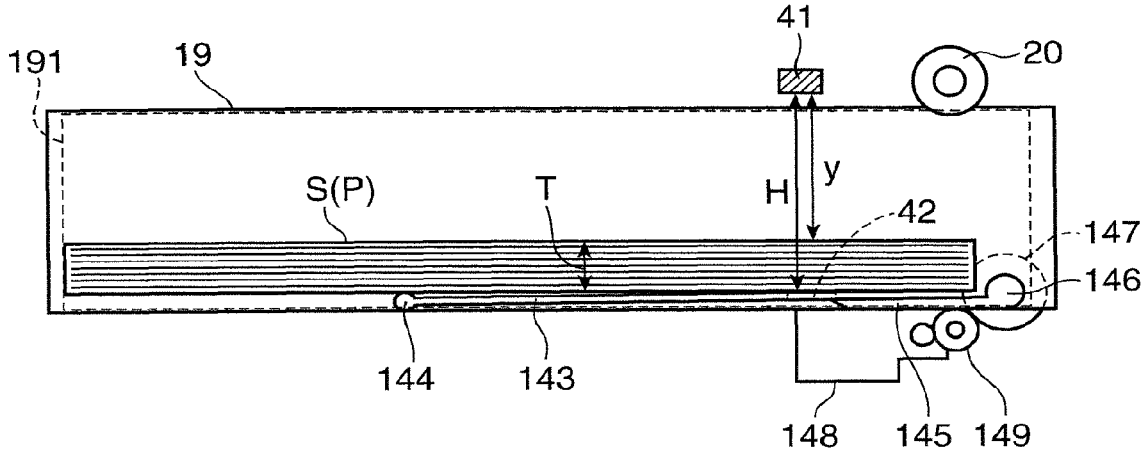

FIGS. 12A and 12B are schematic cross-sectional diagrams illustrating an example of a paper feeding unit 19 in the third embodiment. FIG. 12A illustrates an instance in which a lifting plate 143 is raised to a paper-feeding position, and FIG. 12B illustrates an instance in which the lifting plate 143 is at a retreat position. The paper-feeding position is a position at which the top face of the paper stack S, placed on the raised lifting plate (lifting section) 143, abuts the pickup roller 20, enabling thereby feeding of the paper sheets. The retreat position is the lowermost position to which the lifting plate 143 is lowered. The paper feeding unit 19 will be explained first with reference to FIG. 12A.

The paper feeding unit 19 comprises a paper feeding cassette (storing section) 191 that can be fitted to and removed from the paper feeding unit 19; the lifting plate 143 pivotable about a fulcrum 144; and a lift arm 145 for modifying the inclination angle of the lifting plate 143. The leading end of the lift arm 145 rises and descends through pivoting about a support shaft 146. The lifting plate 143 and the lift arm 145 are disposed in a paper feeding cassette 191.

A motor-side gear 149 is concentrically fixed to the driving shaft of a lift motor (driving section) 148, while a lift gear 147 is integrally fixed to the support shaft 146. The support shaft 146 is integral with the lift arm 145 and mates with the motor-side gear 149 via a coupling not shown. Normal and reverse driving of the lift motor 148 is transmitted to the lifting plate 143 via the motor-side gear 149, the lift gear 147, the support shaft 146 and the lift arm 145, so that the lifting plate 143 pivots normally and reversely about the fulcrum 144. A below-described control unit controls the driving of the lift motor 148.

A pickup roller (transport section) 20 is provided at a paper-feeding position immediately above the leading end of the lifting plate 143 at each paper feeding unit 19, in such a manner that the topmost paper sheet P of the paper stack S placed on the lifting plate 143 is fed out towards the paper transport path 32 through rotation of the pickup roller 20. The lift motor 148 causes the motor-side gear 149 to rotate, in order to gradually increase the inclination angle of the lifting plate 143 in such a manner that the topmost face of the paper stack S abuts the pickup roller 20 as the number of paper sheets P placed on the lifting plate 143 decreases by being fed out. As a result, the topmost face of the paper stack S placed on the lifting plate 143 abuts the pickup roller 20 at all times, and hence the paper sheet P at the topmost face of the paper stack S can be fed out by the pickup roller 20 at all times, in spite of the decreasing number of paper sheets.

In the ordinary mode of the image forming apparatus 1, the lift motor 148 causes the motor-side gear 149 to turn, to gradually increase thereby the inclination angle of the lifting plate 143, in such a manner that the topmost face of the paper stack S placed on the lifting plate 143 abuts the pickup roller 20 at all times, as illustrated in FIG. 12A. In the power saving mode, supply of power to the lift motor 148 is discontinued, and hence the lift gear 147 remains locked at the state it was in upon switching from the ordinary mode to the power saving mode. That is, the inclination angle of the lifting plate 143 at the time of switching to the power saving mode is preserved.

When the paper feeding cassette 191 is pulled out of the paper feeding unit 19, the lift gear 147 is unlocked, whereupon the lift arm 145 is acted upon by the weight of the lifting plate 143 and swings towards the bottom of the paper feeding cassette 191, as illustrated in FIG. 12B. At the same time the lifting plate 143 drops back to the retreat position. Paper is then replenished into the paper feeding cassette 191, and the paper feeding cassette 191 is inserted again into the paper feeding unit 19. At this time the lifting plate 143 remains in the retreat position illustrated in FIG. 12B, since in the power saving mode no power is supplied to the lift motor 148.

Thereafter, the power saving mode is switched to the ordinary mode, whereupon power is supplied to the lift motor 148, which causes the motor-side gear 149 to turn so as to raise the lifting plate 143 to a position at which the topmost face of the paper stack S placed on the lifting plate 143 abuts the pickup roller 20.

The entire lifting plate 143 becomes thus tilted by being raised through driving of the lift motor 148, in such a manner that the topmost face of the paper stack S is positioned so as to abut the pickup roller 20 at all times. The inclination angle of the lifting plate 143 varies depending on the number of the remaining sheets in the paper stack S, and hence the number of sheets in the paper stack S was detected conventionally on the basis of the angle of the lifting plate 143.

However, the lifting plate 143 returns to the retreat position, as illustrated in FIG. 12B, when the paper feeding cassette 191 is pulled out of the paper feeding unit 19. The lift motor 148 fails to start when paper is replenished into the paper feeding cassette 191 and the paper feeding cassette 191 is fitted again to the paper feeding unit 19, since supply of power to the circuits of the power system is discontinued in the case that the power saving mode is active at that time. That is, the lifting plate 143 remains at the retreat position and does not rise to the paper-feeding position. This is problematic in that, if paper is replenished by pulling out the paper feeding cassette 191 during the power saving mode, the number of paper sheets cannot be detected after reverting to the ordinary mode.

Therefore, the number of sheets in the paper stack S is detected by way of a distance sensor 41 that is connected to the power source system and that is powered at all times, also during the power saving mode. The distance sensor 41, which is disposed above the lifting section 143, measures the distance to the topmost face of the paper stack S at a time when the lifting plate 143 is in the retreat position, and outputs the detected distance to a below-described control unit. The control unit calculates the number of sheets in the paper stack S on the basis of the distance detected by the distance sensor 41. As a result, the number of sheets in the paper stack S can be detected also when paper is replenished by removing the paper feeding cassette 191 from the paper feeding unit 19 during the power saving mode. This improves the user-friendliness of the image forming apparatus 1.

Figure 13:
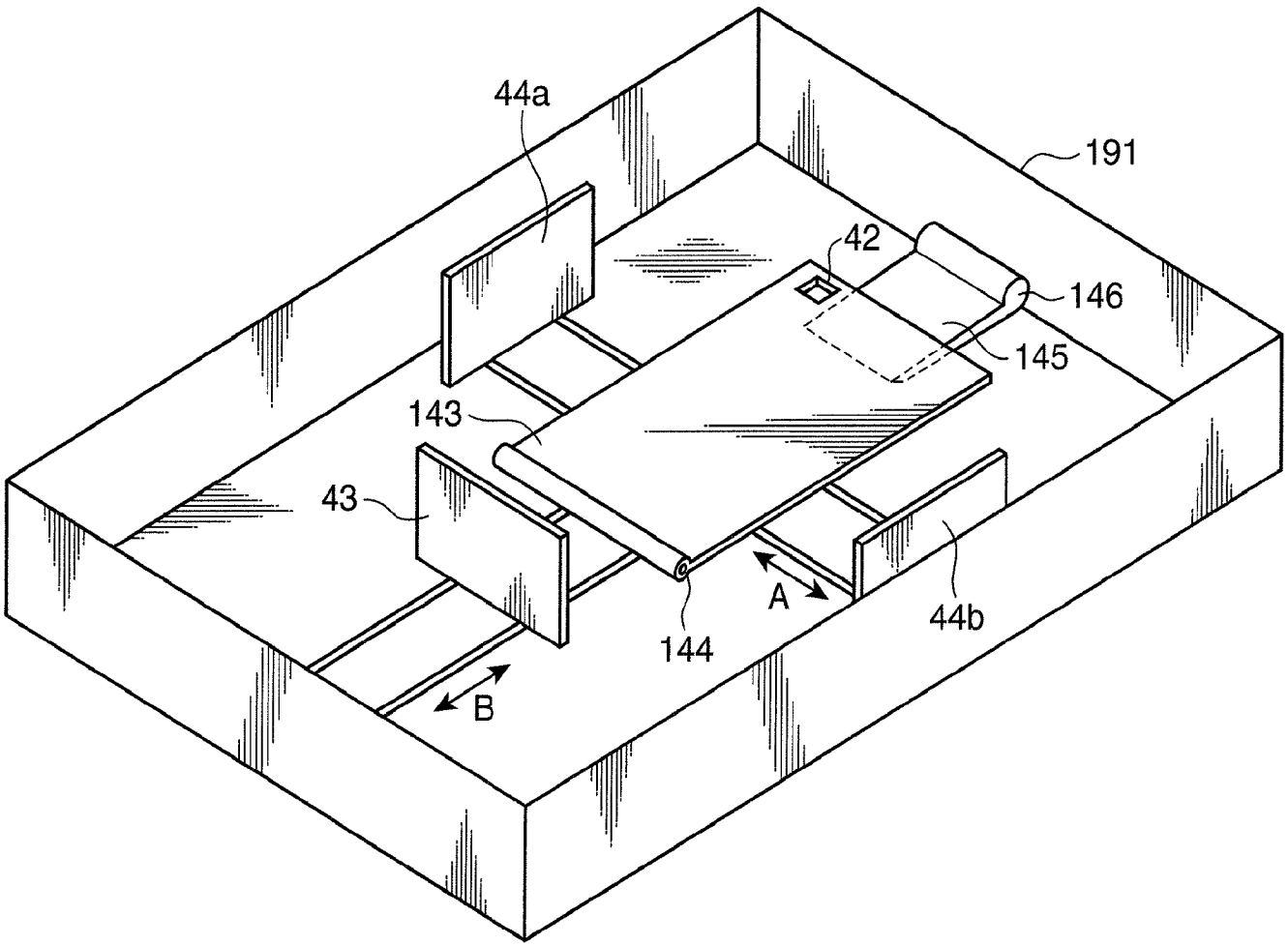
FIG. 13 is a perspective-view diagram of the paper feeding unit.

FIG. 13 is a schematic perspective-view diagram of the paper feeding cassette 191. In addition to the lifting plate 143 and the lift arm 145, the paper feeding cassette 191 comprises a width-matching cursor pair 44*a* and 44*b* for aligning the stored paper stack S in the width direction; and a rear end cursor 43 that aligns the rear end of the paper stack S. The width-matching cursor pair 44*a* and 44*b* is provided so that each cursor can move back and forth in the sheet width direction (direction of arrow A in FIG. 13), along a guide rail. The paper sheets P are fed in the direction toward a side of the lifting arm 145 of the arrow B, and hence the rear end cursor 43 is provided so as to be capable of moving back and forth parallelly to the sheet transport direction along guide rails (i.e. in the direction of arrow B in FIG. 13). The paper stack S can be stored at a predetermined position in the paper feeding cassette 191 through displacement of the width-matching cursor pair 44*a* and 44*b* and the rear end cursor 43 in accordance with the size of the stored paper sheets.

The lifting plate 143 has also an opening 42 at an irradiation position of the light emitted by the distance sensor 41. The distance sensor 41 measures the distance down to the topmost face of the paper stack S at a time when the paper stack S is placed on the lifting plate 143. The opening 42 allows the distance sensor 41 to measure the distance downwards of the lifting plate 143 (up to the bottom of the paper feeding cassette 191), through the opening 42, when there is no paper on the lifting plate 143. For instance, a measurement distance measured beforehand by the distance sensor 41 at a time when the lifting plate 143 is at the retreat position, with no paper thereon, is stored in a storage unit or the like. Later on, when the distance detected by the distance sensor 41 is equal to the stored distance, it means that the distance sensor 41 has measured a distance below the lifting plate 143, through the opening 42, as a result of which there can be reliably concluded that paper has run out.

The presence of the opening 42 causes the distance detected by the distance sensor 41 to vary abruptly at an instant when no recording medium is placed on the lifting plate 143. In such a case, moreover, reflection light of the light emitted by the distance sensor 41 fails to strike the distance sensor 41. This characteristic may be exploited to allow determining out-of-paper occurrences when the distance detected by the distance sensor 41 is equal to or greater than a predetermined distance or cannot be measured. The control unit 91 can reliably detect thereby the presence or absence of recording medium.

Preferably, the distance sensor 41 and the opening 42 are disposed in such a manner that the lift arm 145 is not positioned within the measurement area of the distance sensor 41, to prevent light emitted by the distance sensor 41 through the opening 42 from being reflected by the lift arm 145.

Figure 14:
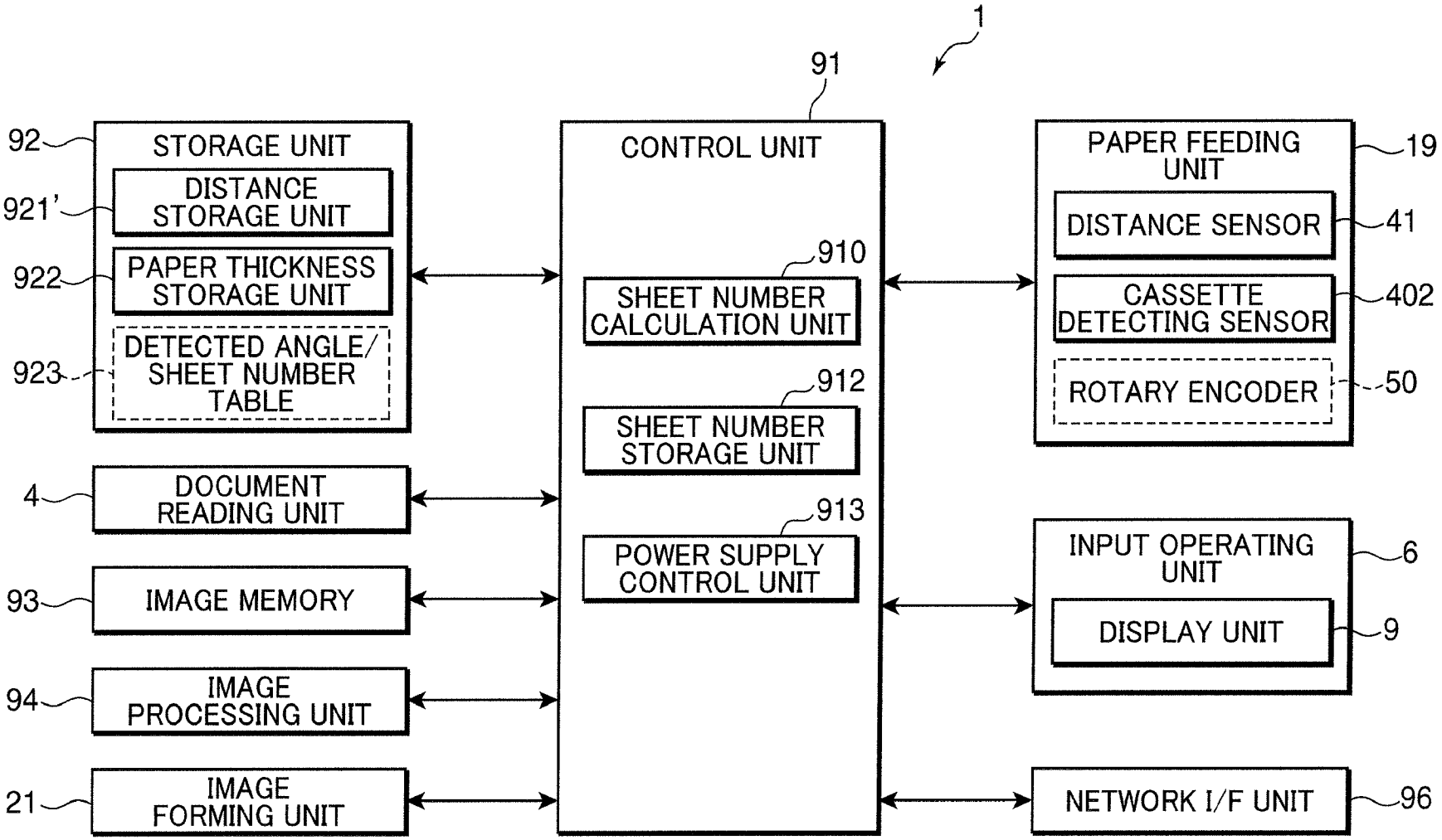
FIG. 14 is a block diagram illustrating the electric configuration of the image forming apparatus.

FIG. 14 is a block diagram illustrating the electric configuration of the image forming apparatus 1. The image forming apparatus 1 comprises the control unit 91, the storage unit 92, the document reading unit 4, the image memory 93, the image processing unit 94, the image forming unit 21, the paper feeding units 19, the input operating unit 6 and the network I/F unit 96. The same constituent elements explained in FIGS. 11 to 12 are denoted with identical reference numerals, and a recurrent explanation thereof will be omitted. The constituent elements enclosed in a dotted line are required elements in a fourth embodiment, and hence will not be explained in the present third embodiment. Features identical to those of the first or second embodiment will not be explained again.

The storage unit 92 stores, for instance, programs and data for executing the various functions of the image forming apparatus 1. The storage unit 92 functions also as a distance storage unit (distance storage unit) 921' and a paper thickness storage unit (thickness storage unit) 922. The distance storage unit 921' stores beforehand the distance from the distance sensor 41 to the lifting plate 143 at a time when the lifting plate 143 is at the retreat position and has no paper placed thereon. The paper thickness storage unit 922 stores beforehand a thickness per paper sheet P (corresponding to a below-described thickness t). The paper thickness storage unit 922 may store the thickness according to, for instance, paper manufacturer, paper product number or the like. In this case, the user inputs, via the input operating unit 6, the manufacturer, product number or the like of the paper sheets P being used, and the control unit 91 reads the relevant thickness from the paper thickness storage unit 922, on the basis of the inputted information. The paper thickness storage unit 922 may also store the thickness of paper sheets P inputted directly by the user via the input operating unit 6.

The paper feeding unit 19 has the distance sensor 41 and a cassette detecting sensor 402. The cassette detecting sensor 402 detects whether the paper feeding cassette 191 is fitted to the paper feeding unit 19, and outputs a detection signal to the control unit 91 when the cassette detecting sensor 402 detects that the paper feeding cassette 191 is fitted.

The control unit (determination unit) 91 comprises, for instance, a CPU (Central Processing Unit). The control unit 91 controls integrally the image forming apparatus 1, for instance, by executing a process of reading a program stored in the storage unit 92, by outputting instructions signals to the various functional units, and by transmitting data. The control unit further comprises a sheet number calculation unit 910, a sheet number storage unit (initial sheet number storage unit) 912 and a power supply control unit (power control unit) 913.

The sheet number calculation unit 910 calculates the initial number of sheets in the paper stack S that is placed on the lifting plate 143, on the basis of the detected distance measured by the distance sensor 41 when paper is replenished by removing the paper feeding cassette 191 from the main body 2, and inserting the paper feeding cassette 191 again into the main body 2, during the power saving mode. When printing starts through transport of paper sheets P from the paper feeding cassette 191 during the ordinary mode, the sheet number calculation unit 910 calculates the number of paper sheets by counting the number of printed sheets and subtracting the number of printed sheets from the initial number of sheets.

The main body 2 has disposed therein the cassette detecting sensor 402 that detects the presence or absence of the paper feeding cassette 191 in the main body 2. The control unit 91 can grasp the fitting state of the paper feeding cassette 191 on the basis of a signal outputted by cassette detecting sensor 402. Power is supplied to the cassette detecting sensor 402 that detects the presence or absence of the paper feeding cassette 191 also in the power saving mode.

An example of a method for calculating the initial number of sheets in the paper stack S will be outlined next with reference to FIG. 12B. Firstly, there is measured beforehand the distance H detected by the distance sensor 41 at a time when one paper is on the lifting plate 143, for instance before shipping of the image forming apparatus 1 out of the factory. The measured distance is stored, for instance, in the storage unit 92. The distance sensor 41 measures then the distance to the topmost face of the paper stack S when the paper feeding cassette 191 is pulled out of the main body 2 and is inserted again therein. The measured distance to the topmost face of the paper stack S at that time is the distance y.

The sheet number calculation unit 910 calculates the thickness (T=H−y) of the paper stack S by subtracting the distance y from the distance H, so that the number of paper sheets n in the paper stack S can be worked out by dividing the resulting thickness T by the thickness t per one paper sheet and adding one (n=1+T/t).

The sheet number storage unit 912 stores the initial number of sheets calculated by the sheet number calculation unit 910. Upon printing start, the sheet number storage unit 912 updates and stores the number of paper sheets calculated by the sheet number calculation unit 910. Upon receiving a request for transmission of the paper sheet number, from a personal computer or the like that is connected to a network via the network I/F unit 96, the control unit 91 sends the paper sheet number stored in the sheet number storage unit 912 to the requesting personal computer. The user can check thereby the number of paper sheets also remotely from the image forming apparatus 1.

The power supply control unit 913 controls the supply of power to the various constituent elements, both in the ordinary mode and the power saving mode. Specifically, the power supply control unit 913 performs control in such a manner that, in the ordinary mode, power is supplied to the entire electric system, and in such a manner that, in the power saving mode, power supply is discontinued to the power system circuit (lift motor 148, image forming unit 21 and so forth), and is supplied only to the logic system circuit (control unit 91, distance sensor 41, storage unit 92 and so forth).

Figure 15:
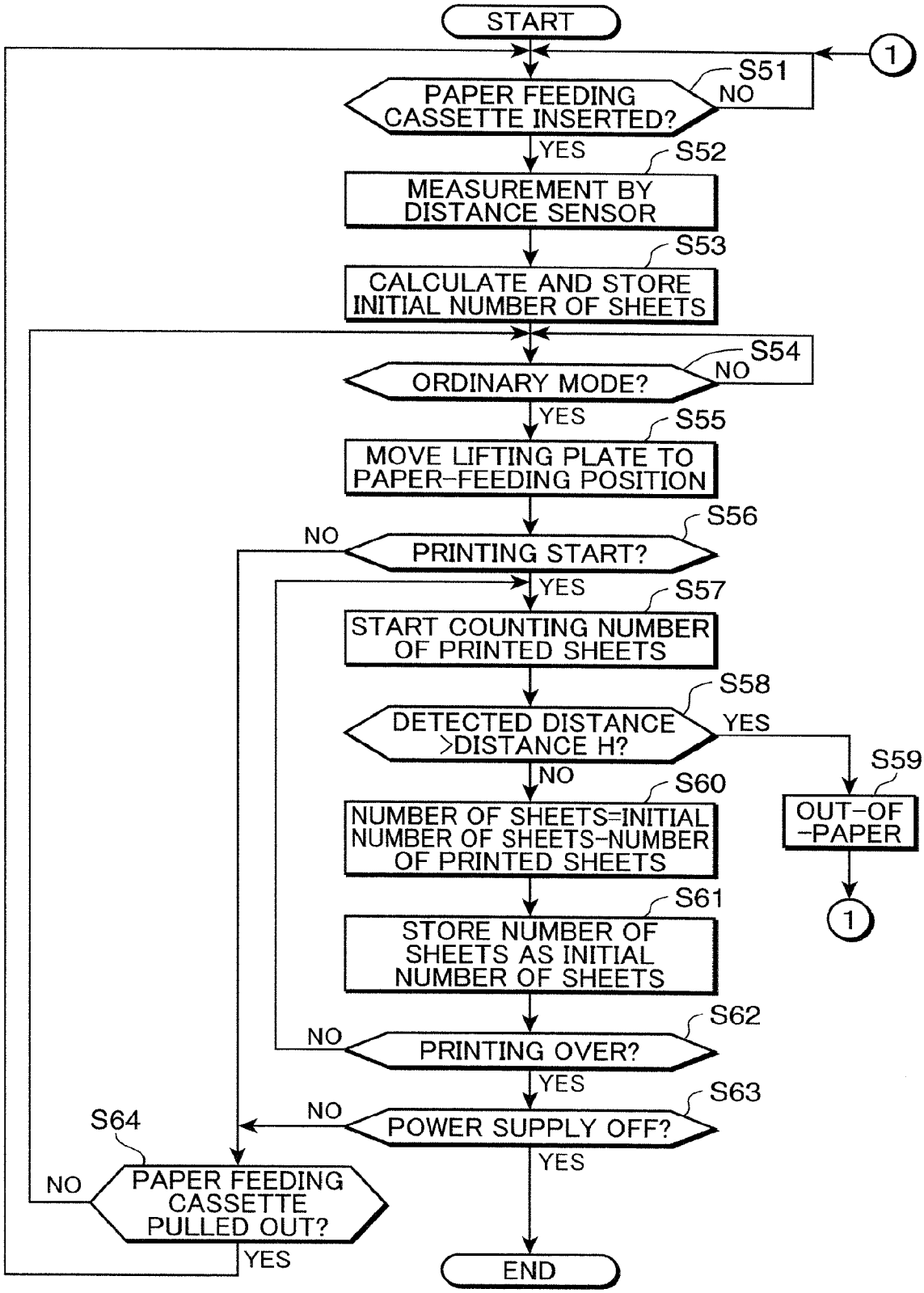
FIG. 15 is a flowchart illustrating the flow of a sheet number detection process in the third embodiment.

FIG. 15 illustrates a flowchart of the flow of a sheet number detection process in the present embodiment. When the cassette detecting sensor 402 outputs a detection signal indicating that the paper feeding cassette 191 is fitted to the main body 2 (step S51; YES), the control unit 91 causes the distance sensor 41 to measure the distance y to the topmost face of the paper stack S (step S52). At this time, the lifting plate 143 is at the retreat position. The sheet number calculation unit 910 calculates the initial number of sheets in the paper stack S on the basis of the distance detected by the distance sensor 41, and the initial number of sheets is stored in the sheet number storage unit 912 (step S53).

When it becomes the ordinary mode from the power saving mode (step S54; YES), the control unit 91 drives the lift motor 148 so as to cause the lifting plate 143 to be moved to the paper-feeding position (step S55). In the power saving mode (step S54; NO), the control unit 91 repeats the determination process of step S54 until switching to the ordinary mode. Upon switching from the power saving mode to the ordinary mode, the power supply control unit 913 starts supplying power to the power system circuit (lift motor 148, image forming unit 21 and so forth).

Next, upon printing start (step S56; YES), the sheet number calculation unit 910 starts counting the number of printed sheets (step S57). During printing, the control unit 91 determines whether the distance detected by the distance sensor 41 is bigger than the distance H, of a time when one paper is on the lifting plate 143, that is stored in the distance storage unit 921' (step S58). When the detected distance is bigger than the distance H (step S58; YES), the control unit 91 concludes that paper has run out, causes a warning message to be displayed on the display unit 9 (step S59), and moves on to the process of step S51.

If the distance detected by the distance sensor 41 is not bigger than or equal to the distance H during printing (step S58; NO), the sheet number calculation unit 910 subtracts the number of printed sheets from the initial number of sheets stored in the sheet number storage unit 912, to calculate thereby the number of paper sheets after printing (step S60). As a method for calculating the number of paper sheets, the sheet number calculation unit 910 may for instance subtract 1 from the value of the initial number of sheets every time that one paper sheet is printed.

The sheet number storage unit 912 updates and stores, as the initial number of sheets, the number of paper sheets after printing as calculated by the sheet number calculation unit 910 (step S61). The control unit 91 determines whether the printing process is over or not (step S62). If the control unit 91 determines that the printing process is not over (step S62; NO), the process returns to S57.

If the control unit 91 determines that the printing process is over (step S62; YES), the control unit 91 determines also whether the power source of the image forming apparatus 1 is switched off or not (S63).

If the power source is not switched OFF (step S63; NO) and the paper feeding cassette 191 has been pulled out of the paper feeding unit 19 (step S64; YES), the control unit 91 moves on to the process of step S51. If the paper feeding cassette 191 is not pulled out (step S64; NO), the control unit 91 moves on to the process of step S54. If the power source is cut off (step S63; YES), the control unit 91 terminates the process.

Thus, when the lifting plate 143 is at the retreat position (steps S51 to S54 in FIG. 15, corresponding to immediately after fitting of the paper feeding cassette 191 during the power saving mode), the number of sheets in the paper stack S is detected on the basis of the distance measurement by the distance sensor 41, and is stored in the sheet number storage unit 912 as the initial number of sheets. When the lifting plate 143 is at the paper-feeding position (steps S56 to S62 in FIG. 15, corresponding, in particular, to halfway during printing in the ordinary mode), the number of sheets in the paper stack S is calculated by subtracting the number of printed sheets from the initial number of sheets.

Conventionally, the number of paper sheets was worked out through detection of the angle of the lifting plate 143. In the power saving mode, however, no power is supplied to the motor 148 that raises the lifting plate 143, and hence once the paper feeding cassette 191 is removed and fitted to the main body 2, the number of paper sheets could not be detected until the mode was reverted to the ordinary mode. As explained above, the number of sheets in the paper stack S is detected herein by way of the distance sensor 41 that is powered at all times, also during the power saving mode, as a result of which the number of sheets in the paper stack S can be detected also when the paper feeding cassette 191 is removed and fitted to the main body 2 during the power saving mode. This allows improving the user-friendliness of the image forming apparatus 1.

Fourth Embodiment

A method for calculating the number of sheets in the paper stack S relying on the distance sensor 41 at all times was explained in the third embodiment. In the fourth embodiment there will be explained a method for obtaining the number of paper sheets by way of the distance sensor 41 and the inclination angle of the lifting plate 143. The mechanical configuration and electric configuration of the image forming apparatus in the present fourth embodiment are largely identical to those of the image forming apparatus 1 in the third embodiment, and hence identical constituent elements will be denoted with the same reference numerals, and a recurrent explanation thereof will be omitted, except for features that are dissimilar.

Figure 16:
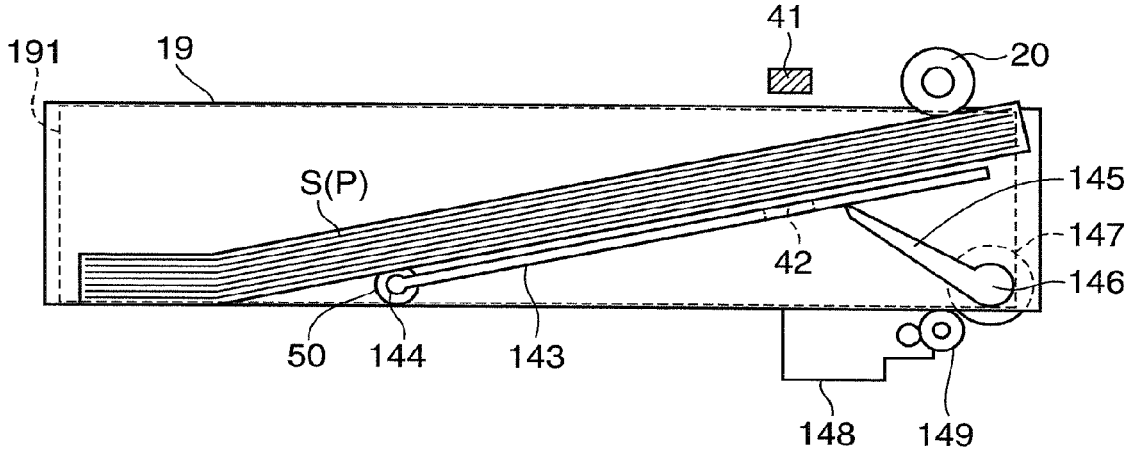
FIG. 16 is a cross-sectional diagram of the paper feeding unit in the fourth embodiment.

FIG. 16 is a schematic cross-sectional diagram illustrating an example of a paper feeding cassette 191 in the present embodiment. A rotary encoder (angle detection unit) 50 is fixed concentrically to the fulcrum 144 of the lifting plate 143. The rotary encoder 50 detects the rotation angle of the fulcrum 144, i.e. the inclination angle of the lifting plate 143.

The inclination angle of the lifting plate 143 becomes smaller as there increases the number of sheets in the paper stack S that is placed on the lifting plate 143, and becomes greater as the number of paper sheets decreases. Therefore, the inclination angle of the lifting plate 143 as detected by the rotary encoder 50 indicates the number of sheets in the paper stack S that is placed on the lifting plate 143.

The method for calculating the number of paper sheets by way of the distance sensor 41, explained in the third embodiment, yields erroneous calculation results as the number of sheets in the paper stack S decreases. These errors derive from, for instance, variability in the precision of the distance detected by the distance sensor 41, and variability in the thickness t per paper sheet P. Also, the sheet number calculation unit 910 must count the number of printed sheets during printing, and must calculate the number of paper sheets after printing, which impacts on the processing load.

In the present embodiment, therefore, a method is explained wherein the number of sheets in the paper stack S is detected on the basis of the distance detected by the distance sensor 41, during the power saving mode, and the number of paper sheets is detected on the basis of the angle detected by the rotary encoder 50, during the ordinary mode, so that the processing load of the control unit 91 is reduced as a result.

The electric configuration of the image forming apparatus 1 in the present embodiment is explained next with reference to FIG. 14. FIG. 14 is a block diagram illustrating the electric configuration of the image forming apparatus 1 in the present fourth embodiment, wherein elements denoted by the dotted lines are added to those of the third embodiment.

The storage unit 92 stores a detected angle/sheet number table (angle/initial sheet number storage unit) 923. The detected angle/sheet number table 923 is a correspondence table in which detected angle and the number of paper sheets are stored mapped to each other. For instance, a table is prepared by checking beforehand the number of paper sheets that correspond to a detected angle, i.e. a number of paper sheets=m1 at a time when detected angle=θ1, number of paper sheets=m2 at a time when detected angle=θ2, and so forth. The resulting table is stored in the storage unit 92.

During the ordinary mode, the control unit 91 obtains the number of paper sheets by reading the number of paper sheets from the detected angle/sheet number table 923, on the basis of the detected angle outputted by the rotary encoder 50. That is, the sheet number calculation unit 910 need not count the number of printed sheets or calculate the number of paper sheets during the ordinary mode. This allows reducing the processing load.

Figure 17:
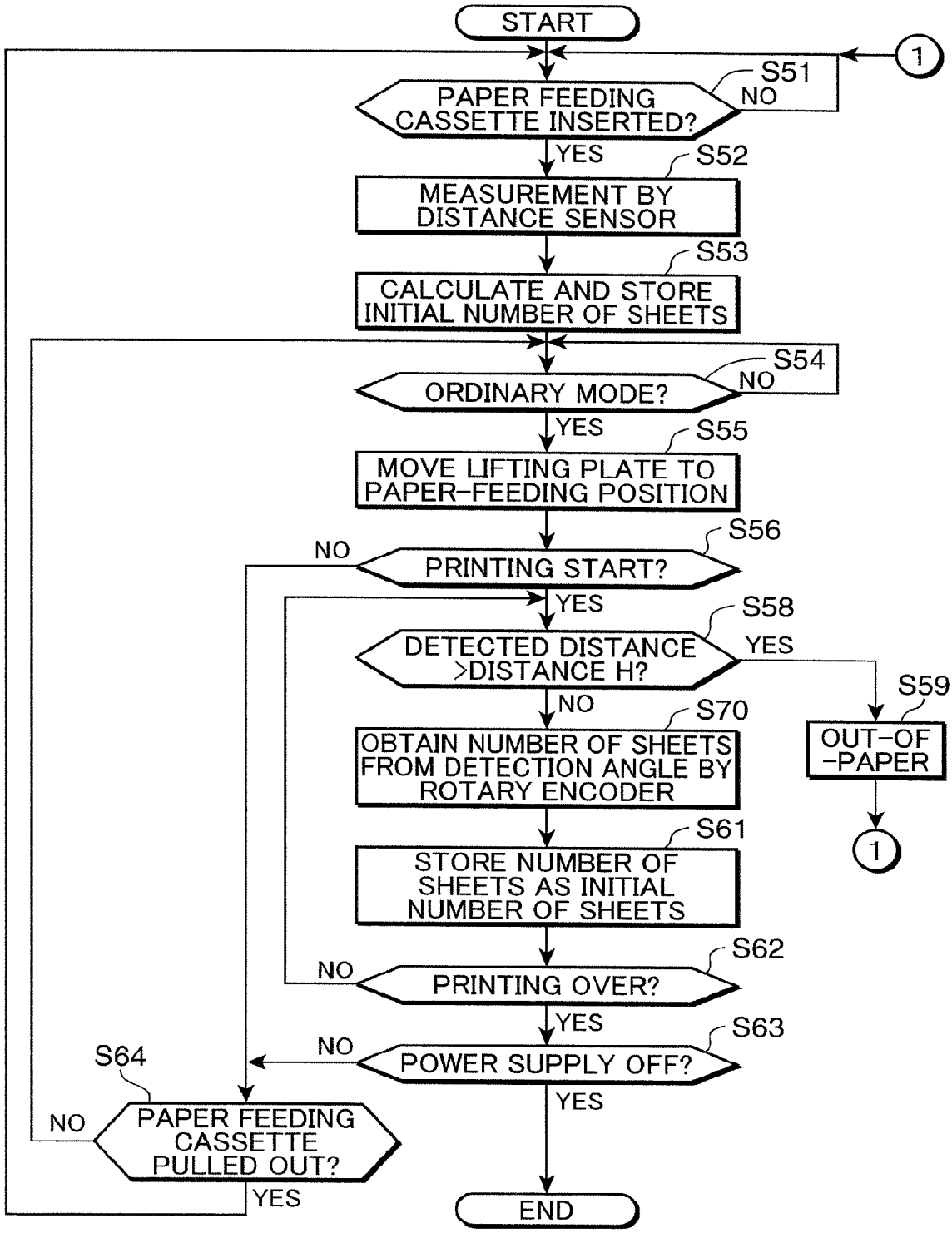
FIG. 17 is a flowchart illustrating the flow of a sheet number detection process in the fourth embodiment.

FIG. 17 illustrates a flowchart of the flow of a sheet number detection process in the paper feeding unit 19 in the present embodiment. When the cassette detecting sensor 402 outputs a detection signal indicating that the paper feeding cassette 191 is fitted to the main body 2 (step S51; YES), the control unit 91 causes the distance sensor 41 to measure the distance y to the topmost face of the paper stack S (step S52). At this time, the lifting plate 143 is at the retreat position. The sheet number calculation unit 910 calculates the initial number of sheets in the paper stack S on the basis of the distance detected by the distance sensor 41, and the initial number of sheets is stored in the sheet number storage unit 912 (step S53).

In the ordinary mode (step S54; YES), the control unit 91 drives the lift motor 148 so as to cause the lifting plate 143 to be moved to the paper-feeding position (step S55). In the power saving mode (step S54; NO), the control unit 91 repeats the determination process of step S54 until switching to the ordinary mode. Upon switching from the power saving mode to the ordinary mode, the power supply control unit 913 starts supplying power to the power system circuit (lift motor 148, image forming unit 21 and so forth).

Next, upon printing start (step S56; YES), the control unit 91 determines, during printing, whether the distance detected by the distance sensor 41 is bigger than the distance H, of a time when one paper is on the lifting plate 143 (step S58). When the detected distance is bigger than the distance H stored in the distance storage unit 921' (step S58; YES), the control unit 91 concludes that paper has run out, causes a warning message to be displayed on the display unit 9 (step S59), and moves on to the process of step S51.

If the distance detected by the distance sensor 41 is not bigger than or is equal to the distance H during printing (step S58; NO), the control unit 91 reads the number of paper sheets from the detected angle/sheet number table 923, on the basis of the detected angle outputted by the rotary encoder 50, and obtains the number of paper sheets (step S70). The sheet number storage unit 912 updates and stores, as the initial number of sheets, the number of paper sheets read by the control unit 91 from the detected angle/sheet number table 923 (step S61). The control unit 91 determines whether the printing process is over or not (step S62). If the control unit 91 determines that the printing process is not over (step S62; NO), the process returns to S58.

If the control unit 91 determines that the printing process is over (step S62; YES), the power source is not switched OFF (step S63; NO) and the paper feeding cassette 191 is removed from the paper feeding unit 19 (step S64; YES), then the control unit 91 moves on to the process of step S51. If the paper feeding cassette 191 is not pulled out (step S64; NO), the control unit 91 moves on to the process of step S54. If the power source is cut off (step S63; YES), the control unit 91 terminates the process.

Thus, when the lifting plate 143 is at the retreat position (steps S51 to S54 in FIG. 17; corresponding to immediately after fitting of the paper feeding cassette 191 during the power saving mode), the number of sheets in the paper stack S is detected on the basis of distance measurement by the distance sensor 41, and is stored in the sheet number storage unit 912 as the initial number of sheets. When the lifting plate 143 is at the paper-feeding position (steps S56 to 62 in FIG. 17; corresponding, in particular, to halfway during printing in the ordinary mode), the number of sheets in the paper stack S is calculated on the basis of the angle of the lifting plate 143 detected by the rotary encoder 50.

As explained above, the number of sheets in the paper stack S is detected on the basis of the distance detected by the distance sensor 41, when the paper feeding cassette 191 is fitted, and on the basis of the angle detected by the rotary encoder 50, during the ordinary mode. The processing load of the control unit 91 for calculating the number of paper sheets after printing can be reduced as a result.

In Prior art (1) set forth in the Description of the Background Art, paper had to be replenished from a manual paper feeding unit, which was cumbersome. In Prior art (2), a measurement unit was disposed above a lifting section, at a position that matched the upstream end, in the transport direction, of the smallest paper size, from among storable paper sizes, and the remaining amount of recording medium was detected. The precision with which the number of remaining sheets is detected is low in this configuration.

In the present invention according to the above-described first and second embodiments, however, an opening for checking the lowermost face of a recording medium is arranged at a position (i.e., the downstream end of the recording medium in the transport direction) that corresponds to an end side of the recording medium at a lifting section that raises at least the end side of the recording medium, in order to cause the recording medium to abut the transport section. Through the opening, the measurement unit measures the distance from below the lifting section to the lowermost face of the recording medium. The height position of the lifting section varies depending on the number of sheets of the recording medium. In consequence, the difference (displacement) between the distance detected by the measurement unit at a time when the number of sheets of stored recording medium is largest, and at a time when the number of stored sheets is smaller than the largest number of sheets, can be made greater than in conventional detection methods. The greater the detected distance difference (displacement) is, the larger becomes the displacement of the detected distance upon transport of one sheet of recording medium. This allows increasing, as a result, the detection precision of the remaining amount of recording medium.

FIGS. 18A to 18C illustrate examples of conventional art. FIGS. 18 A to 18C are a set of cross-sectional diagrams of a paper feeding device 900 in which a distance sensor 904, provided above a stored paper stack S, detects the number of remaining sheets. FIG. 18A illustrates a state in which the paper stack S having the largest number of sheets is stored in the paper feeding device 900. The paper stack S is placed on a lifting plate 910, and a pickup roller 93 transports sheet1 which is the topmost face of the paper stack S out of the paper feeding device 900. A rear end cursor 92 aligns the rear end of the paper stack S. A distance sensor 904 is disposed, above the paper stack S, matching the position of the rear end of the smallest paper size. As shown in FIG. 18B, the lifting plate 910 is a lifting mechanism that rises as the sheet are transported out and the number of sheets in the paper stack S decreases accordingly. The lifting plate 910 is driven and controlled in such a manner that the sheet at the topmost face of the paper stack S abuts the pickup roller 93 at all times. FIG. 18C illustrates a state in which one sheet P is left in the paper feeding device 900.

The maximum displacement y of the distance detected by the distance sensor 904 is determined with reference to FIG. 18C. The maximum displacement denotes herein the difference in the measurement results by the distance sensor 904 between the state in which a paper stack S of the largest number of sheets is stored in the paper feeding device 900 (FIG. 18A), and an one-sheet-remaining state (FIG. 18C). The upstream end of the lifting plate 910 in the transport direction of the sheets P is an origin (0). Herein, A denotes the position of the pickup roller 93 in the transport direction of the sheets P, with respect to the origin, and B denotes the maximum displacement of the top face of the paper stack S at the origin. Thus, the displacement (B) corresponds to the thickness of the paper stack S at a time when the largest number of sheets is stored in the paper feeding device 900. Further, x denotes the position of the distance sensor 904 in the transport direction of the sheets P, with respect to the origin, and y denotes the maximum displacement in the measurement results of the distance sensor 904, at position x.

The maximum displacement y of the distance sensor 904 is worked out by triangle similarity, namely:

$$A:B=(A-x):y$$

$$Ay=(A-x)*B$$

$$y=\{(A-x)*B\}/A \quad (1)$$

The maximum displacement y of the distance sensor 904 decreases as the distance sensor 904 is positioned further spaced apart from the origin towards the upstream side in the transport direction of the sheets P (i.e. as the position of the distance sensor 904 moves further away from the origin). That is, the number of remaining sheets in the paper stack S is grasped less accurately as the displacement per one sheet becomes smaller.

In a case of a so-called high-capacity paper feeding device, where not only one end side of the lifting plate 910 is raised up, as in FIG. 18A to 18C, but the entire paper stack is raised through lift-up of the entire lifting plate, the distance between the overhead distance sensor and the topmost face of the paper stack changes no more once the paper stack is lifted up. As a result, the number of remaining sheets can no longer be measured on the basis of the measurement results by the distance sensor.

In the invention according to the first and second embodiments, however, the number of remaining sheets in the device can be detected more accurately than in the above conventional examples.

In Prior art (3) described in the Description of the Background Art, the number of remaining sheets cannot be detected when the lifting plate is not raised up. Recent years have witnessed a growing presence of image forming apparatuses having an ordinary mode and a power saving mode for reducing power consumption vis-à-vis that of the ordinary mode. In the power saving mode, power is supplied to the circuits of the logic system, such as control devices, sensors and so forth, but power supply is discontinued for circuits of the power system, for instance motors, motor drivers and so forth. Therefore, it may now happen that, during the power saving mode, the number of sheets in the paper feeding device is not detected immediately upon replenishment of paper in the paper feeding device, but is detected once the lifting plate is raised up when back in the ordinary mode. As a result, the user cannot then know the number of sheets during the power saving mode, which is inconvenient.

In the above-described invention according to the third embodiment, by contrast, the measurement unit, to which power is supplied also during the power saving mode, is disposed above the lifting section, and the number of sheets of the recording medium is calculated on the basis of the measurement results of the measurement unit. As a result, the number of sheets of the recording medium can be detected also when the lifting section is at a retreat position closest to the bottom face of the storing section, i.e. at the lowest position of the lifting section, during the power saving mode. This allows increasing the user-friendliness of the paper feeding device.

Further, the invention according to the above-described fourth embodiment allows determining the number of sheets of the recording medium that is placed on the lifting section, through reading of a number of sheets of the recording medium from an angle/initial sheet number storage unit, on the basis of the inclination angle of the lifting section as detected by an angle detection unit, after switching from the power saving mode to the ordinary mode. This allows reducing the software processing load. Upon switching to the ordinary mode, thus, the number of sheets of recording medium in the paper feeding device can be calculated by detecting the number of sheets of recording medium at an arbitrary point in time, by way of the measurement unit, and by subtracting the number of transported sheets from that detected number of sheets. As a result, it is no longer necessary to store beforehand, in a memory or the like, the number of sheets of the recording medium prior to switching to the ordinary mode.

This application is based on Japanese Patent application ser. Nos. 2009-148239, 2009-153365 and 2010-127775 filed in Japan Patent Office on Jun. 23, 2009, Jun. 29, 2009 and Jun. 3, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A paper feeding device, comprising:

a storing section which is removably fitted to a device main body, and in which a recording medium is stored;

a transport section which feeds out and transports, sheet by sheet, the recording medium stored in the storing section;

a lifting section which is provided in the storing section and on which the recording medium is placed, and which is raised and lowered between a retreat position closest to the bottom face of the storing section and a paper-feeding position at which the topmost face of the placed recording medium abuts the transport section;

a driving section which raises and lowers the lifting section;

a measurement unit which is disposed above the lifting section and which measures a distance down to the topmost face of the recording medium placed on the lifting section when the lifting section is at the retreat position;

a sheet number calculation unit which calculates the number of sheets of the recording medium that is placed on the lifting section, on the basis of the distance to the topmost face of the recording medium as measured by the measurement unit; and a power control unit which has an ordinary mode in which power is supplied to the transport section, the driving section, the measurement unit and the sheet number calculation unit, and a power saving mode in which power is supplied to the measurement unit and the sheet number calculation unit, and which controls a supply of power to the sections and units, power consumption in the power saving mode being lower than in the ordinary mode, wherein in the ordinary mode, the driving section displaces the lifting section in such a manner that the lifting section is at the paper-feeding position at all times, and in the power saving mode, the driving section displaces the lifting section to the retreat position and does not displace the lifting section from the retreat position to the paper-feeding position.

2. The paper feeding device according to claim 1, further comprising:

a distance storage unit which stores beforehand a distance from the measurement unit to the lifting section when the lifting section is at the retreat position and one sheet of the recording medium is placed thereon; and a thickness storage unit which stores beforehand a thickness per sheet of the recording medium, wherein the sheet number calculation unit calculates, as the number of sheets of the recording medium placed on the lifting section, resulting from adding 1 to a quotient of a difference between the distance stored in the distance storage unit and the distance to the topmost face of the recording medium as measured by the measurement unit, divided by the thickness per one sheet of the recording medium as stored in the thickness storage unit.

3. The paper feeding device according to claim 1, further comprising an initial sheet number storage unit which stores the number of sheets of the recording medium as calculated by the sheet number calculation unit, wherein after the driving section has displaced the lifting section to the paper-feeding position, the sheet number calculation unit counts the number of sheets of the recording medium transported by the transport section, and calculates, as the number of sheets of the recording medium placed on the lifting section, a value obtained by subtracting the counted number of transported sheets of the recording medium from the number of sheets of the recording medium as stored in the initial sheet number storage unit.

4. The paper feeding device according to claim 1, further comprising a determination unit which determines the presence or absence of the recording medium placed on the lifting section, wherein the lifting section has an opening at a position that is irradiated by an outgoing light beam from the measurement unit, and the determination unit determines that no recording medium is on the lifting section when a detection result from the measurement unit is a distance measured down to below the lifting section, through the opening.

* * * * *